US005709976A

United States Patent [19]

Malhotra

[11] Patent Number: 5,709,976

[45] Date of Patent: Jan. 20, 1998

[54] COATED PAPERS

[75] Inventor: Shadi L. Malhotra, Mississauga, Canada

[73] Assignee: Xerox Corporation, Stamford, Conn.

[21] Appl. No.: 656,814

[22] Filed: Jun. 3, 1996

[51] Int. Cl.[6] ..... B41M 5/00; B41J 2/01

[52] U.S. Cl. ..... 430/124; 347/105; 428/195; 428/211; 428/215; 428/216; 428/423.1; 428/481; 428/484; 428/488.1; 428/511; 428/521; 428/522; 430/126

[58] Field of Search ..... 428/195, 211, 428/215, 216, 423.1, 481, 484, 488.1, 511, 521, 522; 347/105; 430/124, 126

[56] References Cited

U.S. PATENT DOCUMENTS

| | | | |
|---|---|---|---|
| 4,734,336 | 3/1988 | Oliver et al. | 428/537.5 |
| 5,053,268 | 10/1991 | Ehara et al. | 428/215 |
| 5,223,338 | 6/1993 | Malhotra | 428/342 |
| 5,302,249 | 4/1994 | Malhotra et al. | 162/135 |
| 5,457,486 | 10/1995 | Malhotra et al. | 347/105 |
| 5,472,757 | 12/1995 | Ogawa et al. | 428/195 |

*Primary Examiner*—Pamela R. Schwartz
*Attorney, Agent, or Firm*—E. O. Palazzo

[57] ABSTRACT

Disclosed is a coated paper which comprises (a) a substrate; (b) a hydrophobic barrier layer comprised of a water insoluble component and a water or alcohol soluble anticurl agent, said hydrophobic barrier layer being present on both sides of the substrate; (c) image receiving coatings situated on the top of both hydrophobic barrier layers, said image receiving coatings being suitable for receiving images of an aqueous ink, said coatings comprising (1) a polymeric binder, (2) a dye fixative, (3) a pigment, (4) a lightfastness inducing agent, and (5) a biocide. In another embodiment, the present invention is directed to a coated paper which comprises (a) a substrate; (b) a hydrophobic barrier layer comprised of a water insoluble component, and a water or alcohol soluble anticurl agent, said hydrophobic barrier layer being present on both sides of the substrate; (c) image receiving coatings situated on the top of both hydrophobic barrier layers, said image receiving coatings being suitable for receiving images developed with electrostatic toner compositions, said coatings comprising (1) a polymeric binder, (2) an antistatic agent, (3) a lightfastness inducing agent, (4) a pigment, and (5) an optional biocide.

27 Claims, No Drawings

COATED PAPERS

BACKGROUND OF THE INVENTION

The present invention is directed to coated papers suitable for use in copying and printing applications. More specifically, the present invention is directed to coated papers suitable for use in both ink jet and electrophotographic imaging processes. One embodiment of the present invention is directed to a coated paper which comprises (a) a substrate; (b) a hydrophobic barrier layer comprised of a water insoluble component and a water soluble or alcohol soluble anticurl agent, said hydrophobic barrier layer being present on both sides of the substrate; (c) an image receiving coating situated on the top of both hydrophobic barrier layers, said image receiving coating being suitable for receiving images of an aqueous ink, said coating comprising (1) a polymeric binder, (2) a dye fixative, (3) a pigment, or filler, (4) a lightfastness inducing agent, and (5) a biocide. In another embodiment, the present invention is directed to a coated paper which comprises (a) a substrate; (b) a hydrophobic barrier layer comprised of a water soluble or alcohol soluble anticurl agent, the hydrophobic barrier layer being present on both sides of the substrate; (c) an image receiving coating situated on the top of both hydrophobic barrier layers, the image receiving coating being suitable for receiving images developed with electrostatic toner compositions, the coating comprising (1) a polymeric binder, (2) an antistatic agent, (3) a lightfastness inducing agent, (4) a filler, and (5) an optional biocide.

Recording sheets suitable for various printing and imaging processes are known, such as a recording sheet which comprises (a) a substrate comprising a first paper ply, a second paper ply, and situated between the first and second plies, a hydrophobic adhesive layer; (b) an image receiving coating situated on at least one surface of the substrate, the image receiving coating being suitable for receiving images of an aqueous ink and suitable for receiving images of an electrostatic toner composition, the coating comprising (1) a polymeric binder, (2) a dye fixative, and (3) an optional pigment.

U.S. Pat. No. 4,500,607 discloses a paper which resists significant distortion in planarity in response to moisture which paper contains a web which carries a predetermined amount of a polymer-filler blend and which has been dried after application of the blend to a finished moisture level below about 4 percent by weight.

U.S. Pat. No. 5,053,268, the disclosure of which is totally incorporated herein by reference, discloses a composite paper suitable for use as writing paper, printing paper or copying paper which includes a synthetic resin film having a thickness of 12 to 30 microns, and a paper sheet laminated on each side of the synthetic resin film and having a Bekk smoothness of 60 to 120 seconds, a density of 0.8 to 1.0 gram/cm$^3$, a degree of sizing of 0.5 to 1.5 seconds, and a thickness of 20 to 25 microns.

U.S. Pat. No. 4,734,336, the disclosure of which is totally incorporated herein by reference, discloses a twin ply uncoated paper for ink jet processes which paper comprises a supporting paper substrate sheet as a first ply, and thereover as a second ply a paper sheet with filler additives attached to the fibers thereof, which additives include for example, amorphous synthetic silicas, inorganic silicates, metal alumino- silicates, or inorganic oxides. Three ply papers are also illustrated wherein there is situated between two second plies a supporting substrate sheet.

U.S. Pat. No. 5,223,338, the disclosure of which is totally incorporated herein by reference, discloses a recording sheet which comprises a substrate, and a coating consisting essentially of (1) quaternary ammonium polymers, (2) an optional binder polymer, and (3) an optional filler.

U.S. Pat. No. 5,302,249, the disclosure of which is totally incorporated herein by reference, discloses a paper comprising a supporting substrate with a coating which comprises a desizing component and a hydrophilic polymer. In an embodiment, the paper comprises a supporting substrate treated with desizing agents selected from the group consisting of (1) hydrophilic poly(dialkylsiloxanes), (2) poly (alkylene glycol), (3) poly(propylene oxide)-poly(ethylene oxide) copolymers, (4) fatty ester modified compounds of phosphate, sorbitan, glycerol, poly(ethylene glycol), sulfosuccinic acid, sulfonic acid and alkyl amine, (5) poly (oxyalkylene) modified compounds of sorbitan esters, fatty amines, alkanol amides, castor oil, fatty acids and fatty alcohols, (6) quaternary alkosulfate compounds, (7) fatty imidazolines; and mixtures thereof.

U.S. Pat. No. 5,314,747, the disclosure of which is totally incorporated herein by reference, discloses a recording sheet which comprises (a) a base sheet, (b) a cationic sulfur compound selected from the group consisting of sulfonium compounds, thiazolium compounds, benzothiazolium compounds, and mixtures thereof, (c) an optional binder, and (d) an optional pigment.

U.S. Pat. No. 5,320,902, the disclosure of which is totally incorporated herein by reference, discloses a recording sheet which consists essentially of a substrate and, in contact with the substrate, a monoammonium compound an optional binder component and an optional filler component.

U.S. Pat. No. 5,441,795, the disclosure of which is totally incorporated herein by reference, discloses a recording sheet which comprises a base sheet and a material selected from the group consisting of pyridinium compounds, piperazinium compounds, and mixtures thereof.

Copending application Ser. No. 08/075,435, the disclosure of which is totally incorporated herein by reference, discloses a recording sheet which comprises a base sheet and a coating mixture comprising (a) a latex binder; (b) a desizing agent; (c) a dye fixative; (d) an optional pigment; and (e) an optional non-latex cobinder.

Copending application U.S. Ser. No. 08/034,917, the disclosure of which is totally incorporated herein by reference, discloses a recording sheet which comprises a base sheet, a phosphonium compound, an optional pigment, and an optional binder.

U.S. Pat. No. 5,457,486, the disclosure of which is totally incorporated herein by reference, discloses a recording sheet which comprises (a) a base sheet, (b) a material selected from the group consisting of tetrazolium compounds, indolinium compounds, imidazolinium compounds, and mixtures thereof, (c) an optional pigment, and (d) an optional binder.

In forming paper, the cellulose fibers are dispersed in a dilute aqueous slurry which is wet laid as a mat or web onto the screen of a conventional Fourdrinier-type machine. After the web has been dewatered, it is dried to a predetermined moisture level upstream of the size press. Paper is often sized with sizing components for the purpose of retarding or preventing penetration of liquids into the structure. Sizing is commonly done by introducing a material into the pulp during the paper making operation. The acid sizing chemicals, such as Mon size available from Monsanto, or alkaline sizing chemicals, such as Hercon-76 available from Hercules, are precipitated onto the fibers primarily for the purpose of controlling penetration of liquids into the final dry paper. This process is known as internal sizing. Surface sizing entails the application of dispersions of film-forming substances such as converted starches, gums, and modified polymers to previously formed paper. Surface sizing imparts strength to the paper; thus high quality printing papers are often surface sized as well. These internally and surface sized papers, when used to print high area (at least about 80 percent, for example) surface coverage with an ink jet printer containing predominantly water based inks, often yield imaged papers which curl into tubes. Furthermore, when these conventional papers are used in color xerography applications, such as, for example, in certain color copiers, these sized papers can exhibit, in some instances, unacceptable curl because of the uneven moisture balance between the printed side and the nonprinted side of the paper once it exits from the copier.

When plain papers are treated with components to improve the quality of ink jet prints thereon, the papers so treated can generate unacceptable curl when employed in electrostatic (particularly electrophotographic) copiers. In addition, when plain papers are treated with components to improve the quality of ink jet prints thereon, these papers still exhibit problems when the imaged sheets contact water. If one side of the imaged sheet comes into contact with water, the image migrates through the sheet and interferes with the image on the other side. In some instances, the showthrough of the washed image can be enhanced that the back side of the paper has more ink than the front side of the paper. Further, in some instances, paper treatment methods which improve intercolor bleed problems in color ink jet images may heighten the severity of showthrough of the images on the side of the paper opposite to that printed. Additionally, many plain papers exhibit inadequate or non-uniform toner fix when imaged with electrostatic toners.

While known compositions and processes are suitable for their intended purposes, a need remains for improved paper recording sheets. In addition, there is a need for improved paper recording sheets suitable for use in both ink jet printing processes and electrostatic printing processes. Further, a need remains for paper recording sheets for ink jet printing wherein images on the sheets exhibit a high degree of waterfastness. A need also exists for paper recording sheets suitable for use in ink jet printing processes wherein images on the sheets exhibit reduced, or minimum curl. There is also a need for paper recording sheets suitable for use in electrostatic printing processes wherein images on the sheets exhibit reduced curl. A further need exists for paper recording sheets suitable for use in both ink jet printing processes and electrostatic printing processes wherein images on the sheets exhibit reduced curl. Additionally, there is a need for paper recording sheets for ink jet printing which exhibit reduced showthrough of the images on the side of the paper opposite to that printed. There is also a need for paper recording sheets for ink jet printing with enhanced optical density. In addition, there is a need for paper recording sheets for ink jet printing which exhibit reduced intercolor bleed. Further, there is a need for paper recording sheets for electrostatic printing processes such as electrophotography which exhibit good toner fix of the image to the sheet. Additionally, there is a need for paper recording sheets suitable for both ink jet printing processes and electrostatic printing processes which exhibit reduced intercolor bleed and reduced showthrough when used for ink jet printing, and which exhibit reduced curl and good toner fix when used for electrostatic printing. There is also a need for paper recording sheets which, when employed to receive electrostatically generated images of a toner, do not, upon being contacted with water, exhibit migration of the image through the sheet to cause showthrough on the sheet surface opposite to that bearing the wetted image. A further need remains for paper recording sheets which, when employed to receive images of an aqueous ink, do not, upon being contacted with water, exhibit migration of the image through the sheet to cause showthrough on the sheet surface opposite to that bearing the wetted image. Additionally, a need remains for paper recording sheets suitable for both ink jet printing processes and electrostatic printing processes which do not, upon being contacted with water, exhibit migration of the image through the sheet to cause showthrough on the sheet surface opposite to that bearing the wetted image. There is also a need for paper recording sheets which enable the generation of ink jet images of acceptable quality and little or no showthrough when images are generated on both surfaces of the recording sheet.

SUMMARY OF THE INVENTION

It is an object of the present invention to provide paper recording sheets with the above noted advantages.

It is another object of the present invention to provide improved paper recording sheets, or coated papers suitable for use in both ink jet printing processes and electrostatic printing processes.

It is yet another object of the present invention to provide paper recording sheets for ink jet printing wherein images on the sheets exhibit a high degree of waterfastness.

It is still another object of the present invention to provide paper recording sheets suitable for use in ink jet printing processes wherein images on the sheets exhibit reduced curl.

Another object of the present invention is to provide paper recording sheets suitable for use in electrostatic printing processes wherein images on the sheets exhibit reduced curl.

Yet another object of the present invention is to provide paper recording sheets suitable for use in both ink jet printing processes and electrostatic printing processes wherein images on the sheets exhibit reduced curl.

Still another object of the present invention is to provide paper recording sheets for ink jet printing which exhibit reduced showthrough of the images on the side of the paper opposite to that printed.

It is another object of the present invention to provide paper recording sheets for ink jet printing with enhanced optical density.

It is yet another object of the present invention to provide paper recording sheets for ink jet printing which exhibit reduced intercolor bleed.

It is still another object of the present invention to provide paper recording sheets for electrostatic printing processes, such as electrophotography, which exhibit good toner fix of the image to the sheet.

Another object of the present invention is to provide paper recording sheets suitable for both ink jet printing processes and electrostatic printing processes which exhibit reduced intercolor bleed and reduced showthrough when used for ink jet printing, and which exhibit reduced curl and good toner fix when used for electrostatic printing.

Yet another object of the present invention is to provide paper recording sheets which, when employed to receive electrostatically generated images of a toner, do not, upon being contacted with water, exhibit migration of the image through the sheet to cause showthrough on the sheet surface opposite to that bearing the wetted image.

Still another object of the present invention is to provide paper recording sheets which, when employed to receive images of an aqueous ink, do not, upon being contacted with water, exhibit migration of the image through the sheet to cause showthrough on the sheet surface opposite to that bearing the wetted image.

It is another object of the present invention to provide paper recording sheets suitable for both ink jet printing processes and electrostatic printing processes which do not, upon being contacted with water, exhibit migration of the image through the sheet to cause showthrough on the sheet surface opposite to that bearing the wetted image.

It is yet another object of the present invention to provide paper recording sheets which enable the generation of ink jet images of acceptable quality and little or no showthrough when images are generated on both surfaces of the recording sheet.

These and other objects of the present invention in embodiments thereof can be achieved by providing a coated paper with (a) a substrate; (b) a hydrophobic barrier layer comprised of a water insoluble component and a water soluble or alcohol soluble anticurl agent, the hydrophobic barrier layer being present on both sides of the substrate; (c) an image receiving coating situated on the top of both hydrophobic barrier layers, said image receiving coatings being suitable for receiving images of an aqueous ink, the coating comprising (1) a polymeric binder, (2) a dye fixative, (3) a filler, (4) a lightfastness inducing agent, and (5) a biocide. In another embodiment, the present invention is directed to a coated paper which comprises (a) a substrate; (b) a hydrophobic barrier layer comprised of a water insoluble component and a water or alcohol soluble anticurl agent, the hydrophobic barrier layer being present on both sides of the substrate; (c) an image receiving coating situated on the top of both hydrophobic barrier layers, the image receiving coating being suitable for receiving images developed with electrostatic toner compositions, the coating comprising (1) a polymeric binder, (2) an antistatic agent (3) a lightfastness inducing agent, and (4) a pigment, or filler.

DETAILED DESCRIPTION OF THE INVENTION

In one embodiment of the present invention, the paper substrate comprises sized blends of hardwood kraft and softwood kraft fibers containing from about 10 to about 90 parts by weight of softwood and from about 10 to about 90 parts by weight of hardwood. Examples of hardwood include Seagull W dry bleached hardwood kraft present in one embodiment in an amount of about 70 parts by weight. Examples of softwood include La Tuque dry bleached softwood kraft present in one embodiment in an amount of about 30 parts by weight. These papers can also contain fillers and pigments in any effective amounts, typically from about 1 to about 75 parts by weight, such as clay (available from Georgia Kaolin Company as Astro-fil 90 clay, Engelhard Ansilex clay), titanium dioxide (available from Tioxide Company as Anatase grade AHR), calcium silicate CH-427-97-8, XP-974 (J. M. Huber Corporation), and the like. The sized substrates can also contain sizing chemicals in any effective amount, typically from about 0.25 parts to about 25 parts by weight of pulp, such as acidic sizing, including Mon size (available from Monsanto), alkaline sizing such as Hercon-76 (available from Hercules), Alum (available from Allied Chemicals as Iron free alum), retention aid (available from Allied Colloids as Percol 292), and the like. Preferred basis weights for the paper plies are from about 40 to about 400 grams per square meter, although the basis weight can be outside of this range. The substrates of the present invention can be of any effective thickness. Typical thickness of a single ply or two-ply substrate prior to applying the coating material varies from about 50 to about 150 microns, and preferably from about 75 to about 125 microns, although the thickness can be outside these ranges. Typical thicknesses for each paper ply of the two-ply sheet varies from about 15 to about 125 microns, and preferably from about 25 to about 75 microns, although the thickness can be outside these ranges.

In another embdiment, the substrate papers of the present invention can be internally reinforced with a synthetic resin such as vinyl acetate copolymer latices, such as 76 RES 7800 from Union Oil Chemicals Divisions and Resyn 25-1103, Resyn 25-1109, Resyn 25-1119, and Resyn 25-1189 from National Starch and Chemical Corporation, ethylene-vinyl acetate copolymer emulsions, such as Airflex ethylene-vinylacetate from Air Products and Chemicals Inc., acrylic-vinyl acetate copolymer emulsions, such as Rhoplex AR-74 from Rohm and Haas Company, Synthemul 97-726 from Reichhold Chemicals Inc., Resyn 25-1140, 25-1141, 25-1142, and Resyn-6820 from National Starch and Chemical Corporation, vinyl acrylic terpolymer latices, such as 76 RES 3103 from Union Oil Chemical Division, and Resyn 25-1110 from National Starch and Chemical Corporation, acrylic emulsion latices, such as Rhoplex B-15J, Rhoplex P-376, Rhoplex TR-407, Rhoplex E-940, Rhoplex TR-934, Rhoplex TR-520, Rhoplex HA-24, and Rhoplex NW-1825 from Rohm and Haas Company, and Hycar 2600 X 322, Hycar 2671, Hycar 2679, Hycar 26120, and Hycar 2600 X347 from B. F. Goodrich Chemical Group, styrene-butadiene latices, such as 76 RES 4100 and 76 RES 8100 available from Union Oil Chemicals Division, Tylac resin emulsion 68-412, Tylac resin emulsion 68-067, 68-319, 68-413, 68-500, 68-501, available from Reichhold Chemical Inc., and DL6672A, DL6663A, DL6638A, DL6626A, DL6620A, DL615A, DL617A, DL620A, DL640A, DL650A available from Dow Chemical Company.

The two sides, or both sides thereover and thereunder of the paper substrate are coated with hydrophobic barrier layers containing anticurl agents. The hydrophobic barrier layer is of any effective thickness. Typically, the thickness is from about 0.1 to about 10 microns, and preferably from about 0.5 to about 3 microns, although the thickness can be outside these ranges. The components of the hydrophobic barrier layer are present in any effective relative amounts, such as the amounts illustrated herein. The water insoluble component of the hydrophobic barrier layer is present in an amount of from about 5 to about 95 parts by weight, and preferably from about 25 to about 70 parts by weight, although the amount can be outside these ranges. Typically, the anticurl agent is present in an amount of from about 95 to about 5 parts by weight, and preferably from about 75 to about 30 parts by weight, although the amount can be outside these ranges. The ink, or image receiving layer is of any effective thickness. Typically, the thickness is from about 1 to about 25 microns, and preferably from about 5 to about 15 microns, although the thickness can be outside these ranges.

The components of the image receiving layer are (1) a polymeric binder, (2) a dye fixative, (3) a filler, (4) a lightfastness inducing agent, and (5) a biocide. The components of the ink receiving layer are present in any effective relative amounts. Typically, the binder is present in the ink receiving layer in an amount of from about 5 to about 35 parts by weight, and preferably from about 10 to about 25 parts by weight, although the amount can be outside these ranges. The dye fixative typically is present in an amount of from about 2 to about 30 parts by weight, and preferably from about 3 to about 15 parts by weight, although the amount can be outside these ranges. The filler is present, typically, in an amount of from about 92.8 to about 22 parts by weight, and preferably from about 86 to about 50 parts by weight, although the amount can be outside these ranges. Typically, the lightfastness inducing agent is present in an amount of from about 0.1 to about 10 parts by weight, and preferably from about 0.4 to about 8 parts by weight, although the amount can be outside these ranges. Typically, the biocide is present in an amount of from about 0.1 to about 3 parts by weight, and preferably from about 0.6 to about 2 parts by weight, although the amount can be outside these ranges.

The components of the toner receiving layer capable of receiving images developed with electrostatic toner compositions are comprised of (1) a polymeric binder, (2) an antistatic agent, (3) a lightfastness inducing agent, (4) a filler, and (5) an optional biocide. The components of the toner receiving layer are present in any effective relative amounts. Typically, the binder is present in the toner receiving layer in an amount of from about 5 to about 55 parts by weight, and preferably from about 10 to about 35 parts by weight, although the amount can be outside these ranges. The antistatic agent typically is present in an amount of from about 2 to about 10 parts by weight, and preferably from about 3 to about 5 parts by weight, although the amount can be outside these ranges. The filler is present, typically, in an amount of from about 92.8 to about 22 parts by weight, and preferably from about 86 to about 50 parts by weight, although the amount can be outside these ranges. Typically, the lightfastness inducing agent is present in an amount of from about 0.1 to about 10 parts by weight, and preferrably from about 0.4 to about 8 parts by weight, although the amount can be outside these ranges. Typically, the biocide is present in an amount of from about 0.1 to about 3 parts by weight, and preferably from about 0.6 to about 2 parts by weight, although the amount can be outside these ranges.

The aforementioned amounts can be determined, for example, as follows. Various blends of the binder, dye fixative, lightfastness inducing agent, fillers, and the biocide were generated in water and coated on to a paper sheet to yield coated papers with a single layer thereover and thereunder. After drying the paper sheet at 100° C., these were tested for coating adhesion, printed with a Xerox Corporation ink jet test fixture to, for example, check print quality, drying times of the images, lightfastness and intercolor bleed. The data was analyzed statistically for optimum range of compositions.

A preferred composition range for the ink receiving layer coating of the coated paper is the binder present in amounts of from about 10 to about 25 parts by weight, the dye fixative present in an amount of from about 3 to about 15 parts by weight, the lightfastness inducing agent, or mixtures thereof present in amounts of from about 0.4 to about 8 parts by weight, the fillers present in amounts of from about 86 parts by weight to about 50 parts by weight, and the biocide compounds present in amounts of from about 0.6 part by weight to about 2 parts by weight based on 100 parts total(10+3+0.4+86+0.6) to (25+15+8+50+2).

A preferred composition range for the toner receiving layer coating of the coated paper is the binder present in amounts of from about 10 to about 35 parts by weight, the antistatic agent present in an amount of from about 3 to about 5 parts by weight, the lightfastness inducing agent, or mixtures thereof present in amounts of from about 0.4 to about 8 parts by weight, the fillers present in amounts of from about 86 parts by weight to about 50 parts by weight, and the biocide compounds present in amounts of from about 0.6 part by weight to about 2 parts by weight based on 100 parts total (10+3+0.4+86+0.6) to (35+5+8+50+2).

Examples of suitable polymeric hydrophobic components of the barrier layer include a polyurethane emulsion, available as grapHsize from Akzo Chemicals Company; polyethylene wax emulsion, available as Dymsol MS-40 from Henkel Corporation, available as Polywax E-2020 from Petrolite Corporation; polysilanes such as polydialkyl silanes like polydimethyl silanes, such as #788 available from Scientific Polymer Products; polydialkyl siloxane such as polydimethylsiloxane, such as #145, #805, #806, #807, #808, #809, #810, #811, #812, #870, available from Scientific Polymer Products; polysiloxane emulsion SYL-OFF 7740, SYL-OFF 7741 catalyst, available from Dow Chemical Compony, polydimethylsiloxane, bis(12-hydroxy stearate) terminated, such as #43,489-2 available from Aldrich Chemicals; polydimethylsiloxane, distearate terminated, such as #43,488-4 available from Aldrich Chemicals; polydimethylsiloxane, hydroxy terminated, such as #43,297-0; 43,298-9; 43,299-7, available from Aldrich Chemicals; polydimethylsiloxane, methoxy terminated, such as #43,536-8, available from Aldrich Chemicals; polydimethylsiloxane, vinyl terminated, such as #43,300-4; #43,301-2, available from Aldrich Chemicals; poly (dimethylsiloxane-co-dimer acid), bis(perfluorododecyl) terminated such as #43,490-6, available from Aldrich Chemicals; polydimethylsiloxane, vinyl terminated, such as #43,300-4, #43,301-2, available from Aldrich Chemicals; SYL-OFF(R) 1171 and X2-7740 emulsions catalyzed by X2-7741 all available from Dow Corning; poly(methyl hydrosiloxane) #17,620-6 available from Aldrich Chemicals; poly(methyl phenyl siloxane) #37,849-6 available from Aldrich Chemicals; polysiloxane polydimethyldimethyl ammonium acetate, available as Abilwax B 9905 from T. H. Goldschmidt, A. G. Germany; α-methylstyrene-dimethylsiloxane block copolymers, such as PS 0965 available from Petrarch Systems; dimethyl siloxane-bisphenol A carbonate block copolymers, such as PSO99 available from Petrarch Systems; poly(dimethylsiloxane-co-diphenylsiloxane), such as #802 available from Scientific Polymer Products; poly(dimethyl siloxane) monocarbinol terminated (PS558, Petrarch Systems Inc.) and dicarbinol terminated (PS555, PS556, Petrarch Systems Inc.); poly (dimethyl siloxane)-b-poly(methyl siloxane alkylene oxide) copolymers (PS 073, PS 072, PS 071, Petrarch Systems Inc.), Alkasil HEP 182-280, Alkasil HEP 148-330, Alkaril Chemicals; non-hydrolyzable copolymers containing S1-C linkages, such as poly(dimethyl siloxane)-b-poly(propylene oxide)-b-poly(ethylene oxide) copolymers (Alkasil NEP 73-70, Alkaril Chemicals); hydrolyzable copolymer containing S1-O-C linkages, such as polyquaternary poly(dimethyl siloxane) copolymer, which can be obtained by the addition reaction of α,ω-hydrogen polysiloxane with epoxides containing olefinic bonds and then reacting the product with a aliamine; mixtures thereof; and the like.

The hydrophobic barrier layer may also contain a monomeric molecule of silane units such as tripropyl silane (Aldrich #27,756-8); tributyl silane (Aldrich #27,877-7); tribenzyl silane (Aldrich #24,956-4); triphenyl silane (Aldrich #14,850-4); triphenylvinyl silane (Aldrich #36, 268-9); phenyltrimethyl silane (Aldrich #19,773-4); 1-(trimethylsilyl)-H-benzotriazole (Aldrich #42,509-5); phenyl 2-(trimethylsilyl)methyl sulfone (Aldrich #30,674-

6); phenyl 2-(trimethylsilyl)ethyl sulfone (Aldrich #37,625-6); phenyl 2-(trimethylsilyl) ethynyl sulfone (Aldrich #29,655-4); ρ-tolyl-2-(trimethylsilyl)ethynyl sulfone (Aldrich #42,334-3); (trimethylsilyl)acetic acid (Aldrich #34,161-4); [2-(trimethylsilyl)ethoxy methyl] triphenyl phosphonium chloride (Aldrich #33,067-1); 1-(trimethylsilyl methyl) urea (Aldrich #25,464-9); (3-trimethylsilyl-2-propynyl)triphenyl phosphonium bromide (Aldrich #29,958-8); octamethyl cyclotetra siloxane (Aldrich #23,569-5); methyl (diphenylmethyl silyl)acetate (Aldrich #30,278-3); dimethyl octadecyl silane (Aldrich #27,613-8); (9,10-dihydro-9oanthracenyl)trimethyl silane (Aldrich #40,612-0); tetrakis (trimethylsilyl)silane (Aldrich #33,143-0); (3-mercapto propyl)trimethoxy silane (Aldrich #17,561-7); 3-glycidoxy propyl trimethoxy silane (Aldrich #23,578-4); 3-amino propyl triethoxy silane (Aldrich #11,339-5); phenyl trimethoxy silane (Aldrich #10,74-4); bis[(3-trimethoxy silyl)propyl] amine (Aldrich #41,335-6); 1,2-bis(dichloromethyl siyl) ethane (Aldrich #43,821-9); 3-(triethoxy silyl) propyl thiocyanate (Aldrich #37,627-2); 4-(triethoxy silyl) butyronitrile (Aldrich #37,415-6); [3-(triethoxy silyl) propyl] trimethyl ammonium chloride (Aldrich #37,629-9); 3-(triethoxy silyl) propyl isocyanate (Aldrich #41,336-4); 3-(triethoxy silyl) propionitrile (Aldrich #12,537-7); ethyl(S)-(−)-2-(tert-butyl dimethyl silyloxy) propionate (Aldrich #42,495-1); 3-(tert-butyl dimethyl silyloxy) glutaric anhydride (Aldrich #34,159-2; bromo dimethyl trityl silane (Aldrich #37,600-0); (3-chloropropyl) trimethoxy silane (Aldrich #25,457-6); chloromethyl trimethoxy silane (Aldrich #39,104-2); chloro tris(1,3-dimethyl butoxy) silane (Aldrich #38,938-2); chloromethyl (2-chlorophenoxy) dimethyl silane (Aldrich #40,761-5); 1,7-dichloro octamethyl tetra siloxane (Aldrich #38,437-2); dichloromethyl phenyl silane (Aldrich #10,478-7); benzyl trichlorosilane (Aldrich #37,449-0); phenyl trichloro silane (Aldrich #P3,670-3); tolyltrichloro silane (Aldrich #41,935-4); dodecyl trichloro silane (Aldrich #28,056-9); chloro tripropyl silane (Aldrich #25,445-2); chloro triisopropyl silane (Aldrich #24,172-5; chloro tributyl silane (Aldrich #28,270-7); chloro tribenzyl silane (Aldrich #24,689-1); chlorodimethyl octadecyl silane (Aldrich #28,910-8); (trichloromethyl) trimethyl silane (Aldrich #37,628-0); or mixtures thereof.

Examples of other suitable hydrophobic components of the barrier layer include fluoropolymer dispersions in water, available as Zepel B, Zepel DR, from E. I. DuPont de Nemours and Company; a fluoropolymer/organic binder dispersion, available as Aerosol CT-88 from Chem-Trend Incorporated; fluorinated hydrocarbon finish, available as Aquasan 542 from Laurel Products Corporation; fatty acid Chrome Complex, available as Cerol A from Sandoz Chemical Corporation; Chrome Complex solution in isopropanol, available as Quilon C, Quilon H, Quilon L, Quilon M, Quilon S from E. I. DuPont de Nemours and Company; paraffin wax emulsions, available as Paracol from Hercules Incorporated; aliphatic hydrocarbon resin emulsion, available as Picconol A100, Picconol A102; pale rosin aqueous dispersions, available as Dresinol 40, Dresinol 41 from Hercules Incorporated; terpene hydrocarbon resin emulsions, available as Picconol A200, Picconol A201 from Hercules Incorporated; microcrystalline wax finely dispersed in C17 fatty acid, available as Forbest MW 23 from Lucas & Meyer GmbH Company; lanolin alcohol W/O emulsion wax, available as Ceralon from Amerchol Corporation; silicone waxes F221, F222, F251, F755, F789, soluble in isopropanol, available from Wacker Silicones Corporation; aluminum salt wax emulsion, available as Hy-Pel GP-4 from GAF Corporation; metallized wax emulsion, available as Repel-O-Tex D and Repel-O-Tex D-5 from Lyndal Chemical Company; heat stable sodium stearate, aluminum distearate, modified aluminum stearate, all being available from Witco Corporation; magnesium stearate, available as Petrac MG-20, MG-20 NF; and zinc stearate, available as Petrac Zn-41, Petrac Zn-42, from Synthetic Products Company; calcium stearate, available as Norfox CS from Norman Fox and Company; stearyl methicone, Abilwax 9809, cetyl dimethicone, Abilwax 9801, stearyl dimethicone, Abilwax 9800, stearoxy dimethicone, Abilwax 2434, behenoxy dimethicone, Abilwax 2440; all being available from TH. Goldschmidt AG., Germany; behenamide, available as Kenamide B, erucamide, available as Kenamide E, stearyl erucamide, available as Kenamide E-180, erucyl erucamide, available as Kenamide E-221, oleamide, available as Kenamide O, oleyl palmitamide, available as Kenamide P-181, stearamide, available as Kenamide S, stearyl stearamide, available as Kenamide S-180, erucyl stearamide, available as Kenamide S-221, ethylene dioleamide, available as Kenamide W-20, ethylene distearamide, available as Kenamide W-40, Kenamide W-40/300, all being available from Witco/Humko Chemical Division; nonyl phenol ethoxylate phosphate ester, available as Emphos CS-141 from Witco Corporation; sodium cumene sulfonate, available as Eltesol SCS, ammonium xylene sulfonate, available as Eltesol AX-40, sodium xylene sulfonate, available as Eltesol SX-30, potassium xylene sulfonate, available as Eltesol PX-40, magnesium xylene sulfonate, available as Eltesol MGX, sodium toluene sulfonate, available as Eltesol ST-90, potassium toluene sulfonate, available as Eltesol PT-45, all being available from Albright & Wilson Company; cocoamphodiacetate, available as Monateric CDX-38, lauroamphodiacetate, Monateric available as 985-A, capryloamphopropionate, available as Monateric Cy Na-50 percent, tallamphopropionate, available as Monateric TA-35, isostearoamphopropionate, available as Monateric ISA-35 percent, cocoamphodipropionate, available as Monateric CAM-40, Monateric CEM-38 percent, caprylic/capric monocarboxylic propionate imidazoline derivative, available as Monateric 810A-50, caprylic dicarboxylic propionate, imidazoline derivative, available as Monateric CyA-50 from Mona Industries Incorporated; and mixtures thereof.

Examples of suitable anticurl agents present in the hydrophobic layer in contact with the paper substrate include, trimethylolpropane (Aldrich 23,974-7); trimethylolpropane ethoxylate (Aldrich 40,977-4; Aldrich 40,978-2; Aldrich 41,616-9;Aldrich 41,617-7); trimethylolpropane triacrylate (Aldrich 24,680-8); trimethylolpropane trimethacrylate (Aldrich 24,684-0); trimethylolpropane ethoxylate triacrylate (Aldrich 41,217-1; 41,219-8); trimethylolpropane propoxylate triacrylate (Aldrich 40,756-9; 40,757-7); trimethylolpropane ethoxylate methylether diacrylate (Aldrich 40,587-1); trimethylol propane tris(2-methyl-1-azirid inepropionate) (Aldrich 40,544-2); neopentyl glycol ethoxylate (Aldrich 41,027-6); neopentyl glycol propoxylate (Aldrich 40,987-1; Aldrich 41,214-7); β-naphthol ethoxylate, available as Hetoxide BN-13 from from Heterene Chemical Company; glycerol propoxylate (Aldrich 37,389-3, Aldrich 37,390-7, Aldrich 37,391-5, Aldrich 37,392-3, Aldrich 37,396-6, Aldrich 41,028-4); glycerol propoxylate-b-ethoxylate triol (Aldrich 37,386-9, Aldrich 37,387-7, Aldrich 37,388-5); glycerol ethoxylate-b-propoxylate triol (Aldrich 40,918-9); pentaerythritol ethoxylate (Aldrich 41,615-0, 41,873-0); pentaerythritol propoxylate (Aldrich 41,874-9, 41,875-7); pentaerythritol propoxylate/ethoxylate (Aldrich 42,502-8); triethanol amine ethoxylate (Aldrich 41,658-4); N-methyl diethanolamine (Aldrich M4,220-3); N-ethyl diethanolamine (Aldrich 11,206-2); N-butyl diethanolamine (Aldrich 12,425-7); N-phenyl diethanolamine (Aldrich P2,240-0); triethanol amine (Aldrich T5,830-0); trioctylamine (Aldrich T8,100-0); ρ-xylylene diamine (Aldrich 27,963-3); 1,4-bis(2-hydroxyethoxy)-2-butyne (Aldrich B4,470-8); pantothenol (Aldrich 29,578-7); 1-phenyl-1,2-ethanediol (Aldrich 30,215-5, P2 405-5); 3-methoxy-1,2-propanediol (Aldrich 26,040-1); 3-allyloxy-1,2-propanediol (Aldrich 25,173-9); 3-ethoxy-1,2-propanediol (Aldrich 26,042-8); 3-phenoxy-1,2-propanediol (Aldrich 25,781-8); 3-octadecyloxy-1,2-propanediol (Aldrich B40-2); 3-(4-methoxy phenoxy)-1,2-propanediol (Aldrich 21,024-2); Mephensin [3-(2-methyl phenoxy)-1,2-propanediol] (Aldrich 28,656-7); 3-(diethylamino)-1,2-propanediol (Aldrich 21,849-9); 2-phenyl-1,2-propanediol (Aldrich 21,376-4); 3-amino-1,2-propanediol (Aldrich A7,600-1); 3-(diisopropyl amino)-1,2-propanediol (Aldrich 25,766-4); 3-(N-benzyl-N-methylamino)-1,2-propanediol (Aldrich 21,850-2); 3-pyrrolidino-1,2-propanediol (Aldrich 21,851-0); 3-piperidino-1,2-propanediol (Aldrich 21,849-9); 3-morpholino-1,2-propanediol (Aldrich 21,848-0); 2,2-dimethyl-1-phenyl-1,3-propanediol (Aldrich 40,873-5); 2-benzyloxy-1,3-propanediol (Aldrich 36,744-3); 4-8-bis (hydroxymethyl) tricyclo [5.2.1.02.6] decane (Aldrich B4,590-9); 1-[N,N-bis(2-hydroxyethyl)isopropanolamine (Aldrich 23,375-7); N,N-bis(2-hydroxypropyl) ethanol amine (Karl Industries); 1-[2-(2-hydroxyethoxy) ethyl]-piperazine, (Aldrich 33,126-0); 1-4-bis(2-hydroxyethyl) piperazine (Aldrich B4,540-2); homovanillyl alcohol (Aldrich 14,883-0); phenethyl alcohol (Aldrich P1,360-6)-0); 2-(hydroxymethyl)-1,3-propanediol (Aldrich 39,365-7); 2-butyl-2-ethyl-1,3-propanediol (Aldrich 14,247-6); 2-piperidine methanol (Aldrich 15,522-5); 2,2,4-trimethyl-1,3-pentanediol (Aldrich 32,722-0); Vitamin E (Aldrich 25,802-4); Vitamin E acetate (Aldrich 24,817-7); Vitamin K (Aldrich 28,740-7); tri(ethylene glycol) dimethylacrylate (Aldrich 26,154-8); triethyl citrate (Aldrich 10,929-0); 3,6-dimethyl-4-octyne-3,6-diol (Aldrich 27,840-8); 2,4,7,9-tetramethyl-5-decyne-4,7-diol (Aldrich 27,838-6); polyethylene glycol-3 butynediol, available as Hetoxide BY-3 from Heterene Chemical Company; and mixtures thereof.

Examples of suitable water dispersible polymeric binders of the image, or ink receiving layers include rubber latices, such as neoprene available from Serva Biochemicals; polyester latices, such as Eastman AQ 29D available from Eastman Chemical Company; vinyl chloride latices, such as Geon 352 from B. F. Goodrich Chemical Group; ethylene-vinyl chloride copolymer emulsions, such as Airflex ethylene-vinyl chloride from Air Products and Chemicals; polyvinyl acetate homopolymer emulsions, such as Vinac from Air Products and Chemicals; carboxylated vinyl acetate emulsion resins, such as Synthemul synthetic resin emulsions 40-502, 40-503, and 97-664 from Reichhold Chemicals Inc. and Polyco 2149, 2150, and 2171 from Rohm and Haas Company; vinyl acetate copolymer latices, such as 76 RES 7800 from Union Oil Chemicals Divisions and Resyn 25-1103, Resyn 25-1109, Resyn 25-1119, and Resyn 25-1189 from National Starch and Chemical Corporation; ethylene-vinyl acetate copolymer emulsions, such as Airflex ethylene-vinylacetate from Air Products and Chemicals Inc.; acrylic-vinyl acetate copolymer emulsions, such as Rhoplex AR-74 from Rohm and Haas Company; Synthemul 97-726 from Reichhold Chemicals Inc., Resyn 25-1140, 25-1141, 25-1142, and Resyn-6820 from National Starch and Chemical Corporation; vinyl acrylic terpolymer latices, such as 76 RES 3103 from Union Oil Chemical Division and Resyn 25-1110 from National Starch and Chemical Corporation; acrylic emulsion latices, such as Rhoplex B-15, Rhoplex P-376, Rhoplex TR-407, Rhoplex E-940, Rhoplex TR-934, Rhoplex TR-520, Rhoplex HA-24, and Rhoplex NW-1825 from Rohm and Haas Company and Hycar 2600 X 322, Hycar 2671, Hycar 2679, Hycar 26120, and Hycar 2600 X347 from B. F. Goodrich Chemical Group; polystyrene latices, such as DL6622A, DL6688A, and DL6687A from Dow Chemical Company; styrene-butadiene latices, such as 76 RES 4100 and 76 RES 8100 available from Union Oil Chemicals Division, Tylac resin emulsion 68-412, Tylac resin emulsion 68-067, 68-319, 68-413, 68-500, 68-501, available from Reichhold Chemical Inc., and DL6672A, DL6663A, DL6638A, DL6626A, DL6620A, DL615A, DL617A, DL620A, DL640A, DL650A from Dow Chemical Company; butadiene-acrylonitrile latices, such as Hycar 1561 and Hycar 1562 from B. F. Goodrich Chemical Group and Tylac Synthetic Rubber Latex 68-302 from Reichholfrom Reichhold Chemicals Inc.; butadiene-acrylonitrile-styrene terpolymer latices, such as Tylac synthetic rubber latex 68-513 from Reichhold Chemicals Inc., mixtures thereof; and the like.

Examples of water soluble binders include (a) hydrophilic polysaccharides and modifications thereof, such as (1) starch (such as starch SLS-280 available from St. Lawrence Starch), (2) cationic starch (such as Cato-72 available from National Starch), (3) hydroxyalkylstarch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch #02382 available from Poly Sciences Inc., and hydroxyethyl starch #06733 available from Poly Sciences Inc.), (4) gelatin (such as Calfskin gelatin #00639 available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like (such as methyl cellulose, Methocel AM 4 available from Dow Chemical Company), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as hydroxyethyl cellulose, Natrosol 250 LR available from Hercules Chemical Company), and hydroxypropyl cellulose (Klucel Type E available from Hercules Chemical Company), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as ethyl hydroxyethyl cellulose, Bermocoll available from Berol Kern. A. B. Sweden), (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxyethyl methyl cellulose, HEM available from British Celanese Ltd., also available as Tylose MH, MHK from Kalle A. G.), hydroxypropyl methyl cellulose (Methocel K35LV available from Dow Chemical Company), and hydroxy butylmethyl cellulose (such as HBMC available from Dow Chemical Company), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1,2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose available from Aqualon Company), (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, (such as carboxymethyl dextrans available from Poly Sciences Inc. as #16058), (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran available from Poly Sciences Inc. as #5178), (18) amino dextran (available from Molecular Probes Inc), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC 7HOF available from Hercules Chemical Company), (20) gum arabic (such as #G9752 available from Sigma Chemical Company), (21) carrageenan (such as #C1013 available from Sigma Chemical Company), (22) Karaya gum (such as #G0503 available from Sigma Chemical Company), (23) xanthan (such as Keltrol-T available from Kelco division of Merck and Company), (24) chitosan (such as #C3646 available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar available from Auqualon Company), (26) cationic guar (such as Celanese Jaguars C-14-S, C-15, C-17, available from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein available from Croda as Croquats), (29) agar-agar (such as that available from Pfaltz and Bauer Inc.), (30) cellulose sulfate salts, wherein the cation is any conventional cation, such as sodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company); (b) vinyl polymers, such as (1) poly(vinyl alcohol) (such as Elvanol available from Dupont Chemical Company), (2) poly(vinyl phosphate) (such as #4391 available from Poly Sciences Inc.), (3) poly(vinyl pyrrolidone) (such as that available from GAF Corporation), (4) vinyl pyrrolidone-vinyl acetate copolymers (such as #02587 available from Poly Sciences Inc.), (5) vinyl pyrrolidone-styrene copolymers (such as #371 available from Scientific Polymer Products), (6) poly (vinylamine) (such as #1562 available from Poly Sciences Inc.), (7) poly(vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl alcohol) ethoxylated #6573 available from Poly Sciences Inc.), and (8) poly(vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl pyrrolidone-diethylaminomethylmethacrylate) #16294 and #16295 available from Poly Sciences Inc.); (c) formaldehyde resins, such as (1) melamine-formaldehyde resin (such as BC 309 available from British Industrial Plastics Limited), (2) urea-formaldehyde resin (such as BC777 available from British Industrial Plastics Limited), and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins available from American Cyanamid Company as Beetle 65); (d) ionic polymers, such as (1) poly(2-acrylamide-2-methyl propane sulfonic acid) (such as #175 available from Scientific Polymer Products), (2) poly(N,N-dimethyl-3,5-dimethylene piperidinium chloride) (such as #401 available from Scientific Polymer Products), and (3) poly(methylene-guanidine) hydrochloride (such as #654 available from Scientific Polymer Products); (e) maleic anhydride and maleic acid containing polymers, such as (1) styrene-maleic anhydride copolymers (such as that available as Scripset from Monsanto, and the SMA series available from Arco), (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173 available from Scientific Polymer Products). (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308 available from Poly Sciences Inc., also available as EMA from Monsanto Chemical Company), (4) butadiene-maleic acid copolymers (such as #07787 available from Poly Sciences Inc.), (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer available from GAF Corporation as Gantrez S-95), and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773 available from Scientific Polymer Products); (f) acrylamide containing polymers, such as (1) poly(acrylamide) (such as #02806 available from Poly Sciences Inc.), (2) acrylamide-acrylic acid copolymers (such as #04652, #02220, and #18545 available from Poly Sciences Inc.), and (3) poly(N,N-dimethyl acrylamide) (such as #004590 available from Poly Sciences Inc.); (g) poly(alkylene imine) containing polymers, wherein alkylene has two (ethylene), three (propylene), or four (butylene) carbon atoms, such as (1) poly(ethylene imine) (such as #135 available from Scientific Polymer Products), (2) poly(ethylene imine) epichlorohydrin (such as #634 available from Scientific Polymer Products), and (3) alkoxylated poly(ethylene imine), wherein alkyl has one (methoxylated), two (ethoxylated), three (propoxylated), or four (butoxylated) carbon atoms (such as ethoxylated poly(ethylene imine) #636 available from Scientific Polymer Products); (h) polyoxyalkylene polymers such as (1) poly(oxy methylene), such as #009 available from Scientific Polymer Products, (2) poly(oxyethylene) or poly(ethylene oxide), such as POLY OX WSRN-3000 available from Union Carbide Corporation, (3) ethylene oxide/propylene oxide copolymers, such as ethylene oxide/propylene oxide/ethylene oxide triblock copolymer, such as Alkatronic EGE-31-1 available from Alkaril Chemicals, propylene oxide/ethylene oxide/propylene oxide triblock copolymers, such as Alkatronic PGP 3B-1 available from Alkaril Chemicals, tetrafunctional block copolymers derived from the sequential addition of ethylene oxide and propylene oxide to ethylene diamine, the content of ethylene oxide in these block copolymers being from about 5 to about 95 percent by weight, such as Tetronic 50R8 available from BASF Corporation, (4) ethylene oxide/2-hdyroxyethyl methacrylate/ethylene oxide and ethylene oxide/hydroxypropyl methacrylate/ethylene oxide triblock copolymers, which can be synthesized via free radical polymerization of hydroxyethyl methacrylate or hydroxypropyl methacrylate with 2-aminoethanethiol using $\alpha,\alpha'$ azobisisobutyronitrile as initiator and reacting the resulting amino-semitelechelic oligo-hydroxyethyl methacrylate or aminohydroxypropyl methacrylate with an isocyanate-polyethylene oxide complex in chlorobenzene at 0° C., and precipitating the reaction mixture in diethylether, filtering and drying in vacuum, (5) ethylene oxide/4-vinyl pyridine/ethylene oxide triblock copolymers, which can be synthesized via anionic polymerization of 4-vinyl pyridine with sodium naphthalene as initiator at −78° C. and then adding ethylene oxide monomer, the reaction being carried out in an explosion proof stainless steel reactor, ionene/ethylene oxide/ionene triblock copolymers, which can be synthesized via quaternization reaction of one end of each 3-3 ionene with the halogenated (preferably brominated) poly (oxyethylene)in methanol at about 40° C., (6) ethylene oxide/isoprene/ethylene oxide triblock copolymers, which can be synthesized via anionic polymerization of isoprene with sodium naphthalene in tetrahydrofuran as solvent at −78° C. and then adding monomer ethylene oxide and polymerizing the reaction for three days, after which time the reaction is quenched with methanol, the ethylene oxide content in the aforementioned triblock copolymers being from about 20 to about 70 percent by weight and preferably about 50 percent by weight, and the like, (7) and epichlorohydrin-ethylene oxide copolymer, such as #155 available from Scientific Polymer Products, as well as mixtures thereof, and the like, as well as blends or mixtures of any of the above, with starches and latexes being particularly preferred because of their availability and applicability to paper. Any mixtures of the above ingredients in any relative effective amounts can be employed.

Examples of suitable dye fixatives and antistatic agents include quaternary acrylic copolymer latexes, particularly those of the formula

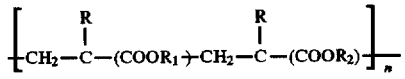

wherein n is a number of from about 10 to about 100, and preferably about 50; R is hydrogen or alkyl like methyl; $R_1$ is hydrogen, an alkyl group, preferably with from about 1 to about 20 carbon atoms, or an aryl group, preferably with from about 6 to about 14 carbon atoms; and $R_2$ is N+(CH3) 3X—, wherein X is an anion, such as Cl—, Br—, I—, HSO3—, SO32—, CH2SO3—, H2PO4—, $HPO_4^{2}$—, $PO_4^{3}$—, $HSO_4$—, $SO_4^{2}$—, $NO_3$—, HCOO—, $CH_3COO$—, $HCO_3$—, $CO_3^{2}$—, SCN—, $BF_4$—, $ClO_4$—, $SSO_3$—, $CH_3SO_3$—, $CH_3CH_2SO_3$—, $CH_3C_6H_4SO_3$—, $SO_3^{2}$—, $BrO_3$—, $IO_3$—, $ClO_3$—, or the like; and the degree of quaternization is from about 1 to about 100 percent, including polymers such as polymethyl acrylate trimethyl ammonium chloride latex, such as HX42-1 available from Interpolymer Corporation, formaldehyde-free GARDOL DR/NF™ available from Apollo Chemical Corporation, polyquaternary amine PERCHEM 553™ available from Chem link industrial, polyquaternary amine POLY PLUS 1290™ available from Betz Paper Chem Inc; ARMOSOFT 420-90™ available from Akzo Chemie Chemicals, Mirapol A-15 and Mirapol WT available from Miranol, Incorporated, Dayton, New Jersey, prepared as disclosed in U.S. Pat. No. 4,157,388, the disclosure of which is totally incorporated herein by reference, Mirapol AZ-1 available from Miranol, Incorporated, prepared as disclosed in U.S. Pat. No. 4,719,282, the disclosure of which is totally incorporated herein by reference, Mirapol AD-1 available from Miranol, Incorporated, prepared as dsclosed in U.S. Pat. No. 4,157,388, Mirapol 9, Mirapol 95, and Mirapol 175 available from Miranol, Incorporated, Dayton, N.J., prepared as disclosed in U.S. Pat. No. 4,719,282, and the like, as well as mixtures thereof.

Also suitable as a dye fixative are monoammonium compounds as disclosed in, for example, U.S. Pat. No. 5,320,902, the disclosure of which is totally incorporated herein by reference, including (A) tetra alkyl ammonium salts, including tetramethyl ammonium bromide (Aldrich 19,575-8), tetramethyl ammonium chloride (Aldrich T1,952-6), tetramethyl ammonium iodide (Aldrich 23,594-6), tetraethyl ammonium bromide (Aldrich 24,105-9), tetraethyl ammonium chloride (Aldrich 11304-2), tetraethyl ammonium iodide (Aldrich 23,593-8), tetrapropyl ammonium bromide (Aldrich 22,556-8), tetrapropyl ammonium iodide (Aldrich 23,595-4), tetrabutyl ammonium bromide (Aldrich 19,311-9), tetrabutyl ammonium chloride (Aldrich 28,888-8), tetrabutyl ammonium iodide (Aldrich 14,077-5), tetrapentyl ammonium bromide (Aldrich 24,197-0), tetrapentyl ammonium chloride (Aldrich 25,896-2), tetrahexyl ammonium chloride (Aldrich 26,383-4), tetrahexyl ammonium bromide (Aldrich 25,281-6), tetrahexyl ammonium iodide (Fluka 87307), tetrahexyl ammonium hydrogen sulfate (Fluka 87299), tetraheptyl ammonium bromide (Aldrich 23,784-1), tetraoctyl ammonium bromide (Aldrich 29,413-6), tetradecyl ammonium bromide (Fluka 87582), tetradodecyl ammonium bromide (Fluka 87249), tetrahexadecyl ammonium bromide (Fluka 87298), tetraoctadecyl ammonium bromide (Aldrich 35,873-8), and the like; (B) monosubstituted trialkyl ammonium salts, such as 2-aminoethyl trimethyl ammonium chloride hydrochloride (Aldrich 28,455-6), 2-bromoethyl trimethyl ammonium bromide (Aldrich 11,719-6), 2-chloroethyl trimethyl ammonium chloride (Aldrich 23,443-5), hexamethylene bistrimethyl ammonium bromide (Aldrich 21,967-3, Fluka 52590), hexamethylene bistrimethyl ammonium chloride (Fluka 52600), 3-carboxypropyl ammonium chloride (Aldrich 23,443-5), decamethylene bis trimethyl ammonium bromide of the formula $[—(CH_2)_5—N(CH_3)_3Br]_2$ (Aldrich 28,547-1), phenyl trimethyl ammonium bromide (Aldrich 13,532-1), phenyl trimethyl ammonium chloride (Aldrich 19,916-8), phenyl trimethyl ammonium iodide (Aldrich 13,914-9), phenyl trimethyl ammonium methosulfate (Aldrich 25,943-6), benzyl trimethyl ammonium chloride (Aldrich 22,557-6, Hipochem Migrator J from High Point Chemical Corporation, Variquat B200 from Sherex Chemicals), benzyl trimethyl ammonium bromide (Aldrich 14,711-7), benzyl triethyl ammonium chloride (Aldrich 14,655-2), benzyl triethyl ammonium bromide (Aldrich 14,712), benzyl tributyl ammonium chloride (Aldrich 19,377-1), benzyl tributyl ammonium bromide (Aldrich 24,378-7), benzyl tributyl ammonium iodide (Aldrich 29,301-6), 4-nitrobenzyl trimethyl ammonium chloride (Aldrich 29,369-5) coco trimethyl ammonium chloride (Arquad C-33, C-33W, C-50 from Akzo Chemie, Noramium MC-50 from Diamond Shamrock, Jet Quat C-50 from Jetco Chemicals, Quartamin CPR from Kao Corporation), palmityl trimethyl ammonium chloride (Adogen 444 from Sherex Chemicals), myristyl trimethyl ammonium bromide (Aldrich 86,042-5), Cetrimide BP (Triple Crown America), oleyl trimethyl ammonium chloride (Noramium MO-50 from Diamond Shamrock), soya trimethyl ammonium chloride (Arquad S-20 Akzo Chemie, Jet Quat S-2C-50 Jetco Chemicals, Tomah Q-S from Tomah), tallow trimethyl ammonium chloride (Arquad T-50, T-27W Akzo Chemie, Jet Quat T-50 Jetco Chemicals, Quartamin TPR from Kao Corporation, Radiaquat 6471 from Oleofina S.A., Adogen 471 from Sherex Chemicals, Querton BGCL50 from Kenobel), hydrogenated tallow trimethyl ammonium chloride (Noramium MSH-50 from Diamond Shamrock, Quartamin HTPR from Kao Corporation, Adogen 441 from Sherex Chemicals), ricinoleamidopropyl trimethyl ammonium methyl sulfate (Rewoquat RTM50, Rewo Quimica), stearyl trimethyl ammonium chloride (Arquad 18-50 from Akzo Chemie), behenyl trimethyl ammonium chloride (Incroquat TMC/P from Croda Universal Inc.), behenyl trimethyl ammonium methosulfate (Incroquat TMS from Croda Universal Inc.), guar hydroxypropyl trimethyl ammonium chloride (cationic guar C-261 from Henkel), butyl tripropyl ammonium bromide (Aldrich 28038-0), methyl tributyl ammonium chloride (Aldrich 25,516-5), methyl tributyl ammonium bromide (Fluka 90802), methyl tributyl ammonium iodide (Fluka 90804), heptyl tributyl ammonium bromide (Fluka 90797), and the like; (C.) disubstituted dialkyl ammonium salts including N,N-dimethyl methylene ammonium chloride (Aldrich 32,449-3), N,N-dimethyl methylene ammonium iodide (Aldrich 21,491-4), chloromethylene dimethyl ammonium chloride (Aldrich 28,090-9), dichloromethylene dimethyl ammonium chloride (Aldrich 16,287-6), 1,5-dimethyl-1,5-diaza undecamethylene polymethobromide (hexadimethrine bromide, Aldrich 10,768-9), dodecyl benzyl dimethyl ammonium bromide (Aldrich 28,088-7), dodecyl benzyldimethyl ammonium chloride (Loraquat B50 Dutton and Reinisch Ltd., Retartder N from Hart Chemicals), coco benzyl dimethylammonium chloride (Merpiquat K-8-2 from Kempen; Nissan cation F2-10R, F2-20R, F2-40E, F2-50 from Nippon Oils and Fats; (Querton KKBCL from Lilachim, benzyl tetradecyl dimethyl ammonium chloride (Arquad DM 14B-90 from Akzo Chemie, Variquat 50ME, 80ME from Sherex Chemicals, Cyncal from Hilton-Davis Chemicals, Aldrich 29,279-6), benzyl cetyl dimethyl ammonium chloride (Querton 16BCL from Lilachim, Aldrich 22,900-8), benzyl octadecyl dimethyl ammonium chloride (Arquad DM 18B-90 from Akzo (2hemie, Varisoft 6112 from Sherex Chemicals, Nissan Cation S2-100 from Nippon Oils and Fats, Carsosoft SDQ-25, SDQ-85 from Lonza Inc, Aldrich 22,901-6), benzyl tallow dimethyl ammonium chloride (Kemamine BQ-9742C from Witco Chemicals and Noramium S-75 from Diamond Shamrock), benzyl hydrogenated tallow dimethyl ammonium chloride (Arquad DMHTB-75 from Akzo Chemie, Kemamine BQ-9702C from Witco Chemicals, Querton 441-BC, HBG BCL from Kenobel), benzyl behenyl dimethyl ammonium chloride (Incroquat behenyl BDQ/P from Croda Universal Inc; Kemamine (Q-2802-C from Witco Chemicals), dioctyl dimethyl ammonium chloride (Querton 28CL from Lilachim), didecyl dimethyl ammonium chloride (Bio-Dac from Bio-Lab Inc, (Querton 210 CL from Lilachim, Bardac 2250 from Lonza Inc., BTC 1010 from Onyx Chemicals), didecyl dimethyl ammonium bromide (Aldrich 29,801-8), dicoco dimethyl ammonium chloride (Accoquat 2(2-75 from Armstrong Chemical Company Ltd., Kemamine Q-6503C from Witco, Jet Quat 2C-75 from Jetco Chemicals, M-Quat 2475 from Mazer, Quartamine DCP from Kao Corporation, Arquad 2C-75 from Akzo Chemie, Radiaquat 6462 from Oleofina S.A., Variquat K300 from Sherex Chemicals, Adogen 462 from Sherex (Chemicals), dicetyl dimethyl ammonium chloride (Adogen 432CG from Sherex Chemicals), distearyl dimethyl ammonium methyl sulfate (Varisoft 137, 190-100P from Sherex Chemicals, Arosurf TA-100 from Sherex Chemicals), disoya dimethyl ammonium chloride (Arquad 2S-75 from Akzo Chemie), ditallow dimethyl ammonium chloride (Adogen 470 from Sherex Chemicals), dihydrogenated tallow dimethyl ammonium methyl sulfate (Accosoft 748 from Stepan), dihydorgenated tallow dimethyl ammonium chloride (Arquad 2HT-75 from Akzo Chemie, Kemamine Q-9702C from Witco, Carsosoft V-90, V-100, Lonza Inc., Adogen 442 from Sherex Chemicals, Varisoft 3262, Varisoft DHT, Sherex Chemicals, Radiaquat 6442 from Oleofina S. A., Jet Quat 2HT-75 from Jetco Chemicals, Accosoft 707 from Stepan), dibehenyl/diarachidyl dimethyl ammonium chloride (Kemamine Q-1902C, 1302C from Witco Chemicals), 1:1 blend of oleyl trimethyl ammonium chloride and dicoco dimethyl ammonium chloride (Arquad S-2C-50 from Akzo Chemie), 1:1 blend of trimethyl tallow ammonium chloride and dimethyl dicoco ammonium chloride (Arquad T-2C-50 from Akzo Chemie and Adogen R-6 from Sherex Chemicals), difatty acid isopropyl ester dimethyl ammonium methyl sulfate (Rewoquat CR 3099 from Rewo Quimica, Loraquat CR 3099 from Dutton and Reinisch), tallow dimethyl trimethyl propylene diammonium chloride (Tomah Q-D-T from Tomah), N-cetyl, N-ethyl morpholinium ethosulfate (G-263 from ICI Americas).

Moreover, suitable as a dye fixative are phosphonium compounds, such as, for example, those disclosed in copending application U.S. Ser. No. 08/034,917, filed Mar. 19, 1993, the disclosure of which is totally incorporated herein by reference, including monophosphonium compounds containing one cationic phosphonium moiety, diphosphonium compounds containing two cationic phosphonium moieties, and polyphosphonium compounds containing more than two cationic phosphonium moieties. Examples of suitable phosphonium compounds include methyl triphenyl phosphonium bromide (Aldrich 13,007-9), methyl triphenyl phosphonium iodide (Aldrich 24,505-4), ethyl triphenyl phosphonium bromide (Aldrich E5,060-4), n-propyl triphenyl phosphonium bromide (Aldrich 13,156-3), isopropyl triphenyl phosphonium iodide (Aldrich 37,748-1), cydopropyl tripheny phosphonium bromide (Aldrich 15,731-7), n-butyl triphenyl phosphonium bromide (Aldrich B10,280-6-), isobutyl triphenyl phosphonium bromide (Aldrich 37,750-3), hexyl triphenyl phosphonium bromide (Aldrich 30,144-2), benzyl triphenyl phosphonium chloride (Aldrich B3,280-7), bromomethyl triphenyl phosphonium bromide (Aldrich 26,915-8), chloromethyl triphenyl phosphonium chloride (Aldrich C5,762-6), 3-bromopropyl triphenyl phosphonium bromide (Aldrich 13,525-9), 3-bromobutyl triphenyl phosphonium bromide (Aldrich 30,537-5), 4-bromobutyl triphenyl phosphonium bromide (Aldrich 27,213-2), 2-dimethyl aminoethyl triphenyl phosphonium bromide (Aldrich 21,544-9), [(3-dimethyl amino) propyl]triphenyl phosphonium bromide (Aldrich 30,585-5), 2-hydroxyethyl triphenyl phosphonium bromide (Aldrich 30,413-1), (2-hydroxyethyl) triphenyl phosphonium chloride (Aldrich H3,065-8), [3-hydroxy-2-methyl propyl] triphenyl phosphonium bromide (Aldrich 32,507-4), Aldrich 32,508-2), (2-hydroxybenzyl triphenyl phosphonium bromide (Aldrich 21,629-1), (formyl methyl) triphenyl phosphonium chloride (Aldrich 30,532-4), (methoxymethyl) triphenyl phosphonium chloride (Aldrich 30,956-7), acetonyl triphenyl phosphonium chloride (Aldrich 15,807-0), carbomethoxymethyl triphenyl phosphonium bromide (Aldrich 25,906-3), (ethoxy carbonyl methyl) triphenyl phosphonium chloride (Aldrich 30,531-6), carbethoxymethyl triphenyl phosphonium bromide (Aldrich C530-0), (tert-butoxy carbonyl methyl) triphenyl phosphonium bromide (Aldrich 36,904-7), phenacyl triphenyl phosphonium bromide (Aldrich 15,133-5), (4-ethoxybenzyl) triphenyl phosphonium bromide (Aldrich 26,648-5), 4-butoxybenzyl triphenyl phosphonium bromide (Aldrich 27,489-5), 2-(1,3-dioxan-2-yl) p-xylylene bis(triphenyl phosphonium bromide) (Aldrich 112-1), tetra phenyl phosphonium bromide (Aldrich 21,878-2), tetra phenyl phosphonium chloride (Aldrich 21879-0), tetra phenyl phosphonium iodide (Aldrich 21880-4), hexadecyl tributyl phosphonium bromide (Aldrich 27,620-0), stearyl tributyl phosphonium bromide (Aldrich 29,303-2), tetramethyl phosphonium bromide (Aldrich Chemical Company 28,826-8), tetramethyl phosphonium chloride (Aldrich 28,827-6), tetraethyl phosphonium bromide (Aldrich 33,365-4), tetraethyl phosphonium chloride (Aldrich 32,539-2), tetraethyl phosphonium iodide (Aldrich 32,540-6), tetrabutyl phosphonium bromide (Aldrich 18,913-8), tetrabutyl phosphonium chloride (Aldrich 14,480-0), and the like, as well as mixtures thereof.

Monoester sulfosuccinates, diester sulfosuccinates and sulfosuccinamates are anionic antistatic components which have been found suitable for use in the toner receiving layer.

Further, the ink/toner receiving layers of the coated papers of the present invention contain lightfastness inducing agents, which agents can contain for the purposes of the present invention in various effective amounts, for example from about 1 to about 5 parts of, a antioxidant, an antiozonant and a UV absorbing compound including, glycerol ρ-amino benzoate, available as Escalol 106 from Van Dyk Corporation; resorcinol mono benzoate, available as RBM from Eastman Chemicals; octyl dimethyl amino benzoate, available as Escalol 507 from Van Dyk Corporation; hexadecyl 3,5-di-tert-butyl-4-hydroxy-benzoate, available as Cyasorb UV-2908, #41,320-8, from Aldrich Chemical Company; octyl salicylate, available as Escalol 106 from Van Dyk Corporation; octyl methoxy cinnamate, available as Parasol MCX from Givaudan Corporation; 4-allyloxy-2-hydroxybenzophenone, available as Uvinul 600, #41,583-9 from Aldrich Chemical Company; 2-hydroxy-4-methoxy benzophenone, available as Anti UVA from Acto Corporation; 2,2'-dihydroxy-4,4'-dimethoxy benzophenone, available as Uvinul D 49, #D11,100-7 from Aldrich Chemical Company; 2-hydroxy-4-(octyloxy)benzophenone, available as Cyasorb UV-531, #41,315-1 from Aldrich Chemical Company; 2-hydroxy-4-dodecyloxy benzophenone, available as DOBP from Eastman Chemicals; 2-(2'-hydroxy-5'-methylphenyl)benzotriazole, available as Tinuvin 900 from Ciba Geigy Corporation; 2-[2'-hydroxy-3,5-di-(1,1-dimethyl benzyl)phenyl]-2H-benzotriazole, available as Topanex 100BT from ICI America Corporation; bis[2-hydroxy-5-tert-octyl-3-(benzotriazol-2-yl)] phenyl methane, available as Mixxim BB/100 from Fairmount Corporation; 2-(3',5'-di-tert-butyl-2'-hydroxyphenyl)-5-chlorobenzotriazole, available as Tinuvin 327 from Ciba Geigy Corporation; 2-(4-benzoyl-3-hydroxyphenoxy) ethylacrylate (Cyasorb UV-416, #41,321-6, available from Aldrich Chemical Company), poly[2-(4-benzoyl-3-hydroxyphenoxy)ethylacrylate], (Cyasorb UV-2126, #41, 323-2, available from Aldrich Chemical Company), N-(1>ethoxycarbonyl phenyl)-N'-ethyl-N'-phenyl formadine, available as Givesorb UV-2 from Givaudan Corporation; 1,1-(1,2-ethane-diyl) bis(3,3,5,5-tetramethyl piperazinone), available as Good-rite UV 3034 from Goodrich Chemicals; tris(3,5-di-tert-butyl-4-hydroxybenzyl) isocyanurate, available as Good-rite UV 3114 from Goodrich Chemicals; nickel bis(o-ethyl(3,5-di-tert-butyl-4-hydroxybenzyl) phosphonate), available as Irgastab 2002 from Ciba Geigy Corporation; [2,2,6,6-tetramethyl-4-piperidinyl)-1,2,3,4-butane tetracarboxylate], available as Mixxim HALS 57 from Fairmount Corporation; [2,2,6,6-tetramethyl-4-piperidinyl/β,β,β',β'-tetramethyl-3,9-(2,4,8,10-tetraoxospiro (5,5) undecane)diethyl]-1,2,3,4-butane tetracarboxylate, available as Mixxim HALS 68 from Fairmount Corporation; [1,2,2,6,6-pentamethyl-4-piperidinyl/β,β,β',β'-tetramethyl-3,9-(2,4,8,10-tetraoxospiro (5,5) undecane)diethyl]-1,2,3,4-butane tetracarboxylate, available as Mixxim HALS 63 from Fairmount Corporation; 2-dodecyl-N-(2,2,6,6-tetramethyl-4-piperidinyl) succinimide, available as Cyasorb UV-3581, #41,317-8, from Aldrich Chemical Company); 2-dodecyl-N-(1,2,2,6,6-pentamethyl-4-piperidinyl) succinimide, available as Cyasorb UV-3604, #41,318-6, from Aldrich Chemical Company; N-(1-acetyl-2,2,6,6-tetramethyl-4-piperidinyl)-2-dodecyl succinimide, available as Cyasorb UV-3668, #41, 319-4, from Aldrich Chemical Company; tetra sodium N-(1, 2-dicarboxyethyl)-N-octadecyl sulfosuccinamate, available as Aerosol 22N from American Cyanamid Corporation; nickel dibutyldithiocarbamate, available as UV-Chek AM-105, from Ferro Corporation; poly(4-hydroxy-2,2,6,6-tetramethyl-1-piperidine ethanol/dimethyl succinic acid), available as Tinuvin 622LD from Ciba-Geigy Corporation; poly(3,5-di-tert-butyl-4-hydroxy hydrocinnamic acid ester)/1,3,5-tris(2-hydroxyethyl)-5-triazine-2,4,6(1H, 3H,5H)-trione, available as Good-rite 3125 from Goodrich Chemicals; poly[N,N-bis(2,2,6,6-tetramethyl-4-piperdinyl)-1,6-hexanediamine-co-2,4-dichloro-6-morpholino-1,3,5,-trazine), available as Cyasorb UV-3346, #41,324-0, from Aldrich Chemical Company; 1-[N-[poly(3-allyloxy-2-hydroxypropyl)-2-aminoethyl]-2-imidazolidinone, #41,026-8, available from Aldrich Chemical Company; and poly(2-ethyl-2-oxazoline), #37,284-6, #37,285-4, #37,397-4, available from Aldrich Chemical Company.

Examples of antioxidant compounds include didodecyl 3,3'-thiodipropionate, available as Cyanox, LTDP, #D12, 840-6, from Aldrich Chemical Company; ditridecyl 3,3'-thiodipropionate, available as Cyanox 711, #41,311-9, from Aldrich Chemical Company; ditetradecyl 3,3'-thiodipropionate, available as Cyanox, MTDP, #41,312-7, from Aldrich Chemical Company; dicetyl 3,3'-thiodipropionate, available as Evanstab 16 from Evans Chemetics Corporation; dioctadecyl 3,3'-thiodipropionate, available as Cyanox, STDP, #41,310-0, from Aldrich Chemical Company; triethyleneglycol bis[3-(3'-tert-butyl-4'-hydroxy-5'-methylphenyl) propionate], available as Irganox 245 from Ciba-Geigy Corporation; octadecyl 3-(3,5-di-tert-butyl-4-hydroxyphenyl)propionate, available as Ultranox 276 from General Electric Company; 1,6-hexamethylene bis(3,5-di-tert-butyl-4-hydroxy hydrocinnamate), available as Irganox 259 from Ciba-Geigy Corporation; tetrakis[methylene(3,5-di-tert-butyl-4-hydroxy hydrocinnamate)], available as Irganox 1010 from Ciba-Geigy Corporation; thiodiethylenebis(3,5-di-tert-butyl-4-hydroxy) hydrocinnamate, available as Irganox 1035 from Ciba-Geigy Corporation; octadecyl 3,5-di-tert-butyl-4-hydroxy hydrocinnamate, available as Irganox 1076 from Ciba-Geigy Corporation; N,N'-hexamethylenebis(3,5-di-tert-butyl-4-hydroxy hydrocinnamide), available as Irganox 1098 from Ciba-Geigy Corporation; 2,2-bis[4-(2-(3,5-di-tert-butyl-4-hydroxyhydrocinnamoyloxy))ethoxy phenyl] propoane, available as Topanol 205 from ICI America Corporation; N-stearoyl-ρ-aminophenol, available as Sucnox-18 from Hexcel Corporation; 2,6-di-tert-butyl-4-methyl phenol, available as Ultranox 226 from General Electric Company; 2,6-di-tert-butyl-ρ-cresol, available as Vulkanox KB from Mobay Chemicals; 2,6-di-tert-butyl-α-dimethylamino-ρ-cresol, available as Ethanox 703 from Ethyl Corporation; 2,2'-isobutylidene-bis(4,6-dimethyl phenol), available as Vulkanox NKF from Mobay Chemicals; 2,2'-methylenebis(6-tert-butyl-4-methylphenol), available as Cyanox 2246, #41,315-5, from Aldrich Chemical Company; 2,2'-methylene bis(6-tert-butyl-4-ethylphenol), available as Cyanox 425, #41,314-3, from Aldrich Chemical Company; tris(4-tert-butyl-3-hydroxy-2,6-dimethylbenzyl) isocyanurate, available as Cyanox 1790, #41,322-4, LTDP, #D12,840-6, from Aldrich Chemical Company; 1,3,5-trimethyl-2,4,6-tris(3,5-di-tert-butyl-4-hydroxybenzyl) benzene, available as Ethanox 300, #41,328-3, from Aldrich Chemical Company; triphenyl phosphite, available as Lankromark LE65 from Harcros Corporation; tris(nonyl phenyl) phosphite, available as Lankromark LE109 from Harcros Corporation; tris(2,4-di-tert-butylphenyl)phosphite, available as Wytox 240 from Olin Corporation; 2,2'-ethylidene bis(4,6-di-tert-butylphenyl) fluorophosphonite, available as Ethanox 398 from Ethyl Corporation; octylated diphenylamine, available as Anchor ODPA from Anchor Corporation; N,N'-β,β'-naphthalene-ρ-phenylenediamine, available as Anchor DNPD from Anchor Corporation; 4,4'-methylene-bis(dibutyldithio carbamate), available as Vanlube 7723 from Vanderbilt Corporation; antimony dialkyldithio carbamate, available as Vanlube 73 from Vanderbilt Corporation; antimony dialkylphosphorodithioate, available as Vanlube 622 from Vanderbilt Corporation; molybdenum oxysulfide dithio carbamate, available as Vanlube 622 from Vanderbilt Corporation; 2,2,4-trimethyl-1,2-hydroquinoline, available as Vulkanox HS from Mobay Corporation; and mixtures thereof.

Examples of antiozonants include N-isopropyl-N'-phenyl-phenylene diamine, available as Santoflex IP from Monsanto Chemicals; N-(1,3-dimethylbutyl)-N'-phenyl-phenylene diamine, available as Santoflex 13 from Monsanto Chemicals; N,N'-di(2-octyl)-ρ-phenylene diamine, available as Antozite-1 from Vanderbilt Corporation; N,N'-bis(1,4-dimethyl pentyl)-ρ-phenylene diamine, available as Santoflex 77 from Monsanto Chemicals; 2,4,6-tris-(N-1,4-dimethyl pentyl-p-phenylene diamino)-1,3,5-triazine, available as Durazone 37 from Uniroyal Corporation; 6-ethoxy-1,2-dihydro-2,2,4-trimethyl quinoline, available as Santoflex AW from Monsanto Chemicals; bis(1,2,3,6-tetrahydrobenzaldehyde)pentaerythritol acetal, available as Vulkazon AFS/LG from Mobay Corporation; parrafin wax, available as Petrolite C-700, Petrolite C-1035 from Petrolite Corporation; and mixtures thereof.

Examples of biocides include (A) nonionic biocides, such as (1) 2-hydroxypropylmethane thiosulfonate (Busan 1005 available from Buckman Laboratories Inc.); (2) 2-(thio cyanomethyl thio)benzothiazole (Busan 30WB, 72WB, available from Buckman Laboratories Inc.); (3) methylene bis(thiocyanate) (Metasol T-10 available from Calgon Corporation; AMA-110 available from Vinings Chemical Company; Vichem MBT available from Vineland Chemical Company; Aldrich 10,509-0); (4) 2-bromo-4'-hydroxyacetophenone (Busan 90 available from Buckman Laboratories); (5) 1,2-dibromo-2,4-dicyano-butane (Metasol CB-210, CB-235, available from Calgon Corporation); (6) 2,2-dibromo-3-nitropropionamide (Metasol RB-20 available from Calgon Corporation; Amerstat 300 available from Drew Industrial Div.); (7) N-α-(1-nitroethyl benzylethylene diamine) (Metasol J-26 available from Calgon Corporation); (8) dichlorophene (6-4 available from Givaudan Corporation); (9) 3,5-dimethyl tetrahydro-2H-,1,3,5-thiadiazine-2-thione (SLIME-TROL RX-28 available from Betz Paper Chem Inc.; Metasol D3T-A available from Calgon Corporation; SLIME ARREST available from Western Chemical Company); (10) a nonionic blend of a sulfone, such as bis(trichloromethyl)sulfone and methylene bisthiocyanate (available as SLIME-TROL RX-38A from Betz Paper Chem Inc.); (11) a nonionic blend of methylene bisthiocyanate and bromonitrostyrene (available as SLIME-TROL RX-41 from Betz Paper Chem Inc.); (12) a nonionic blend of 2-(thiocyanomethylthio) benzothiazole (53.2 percent by weight) and 2-hydroxypropyl methanethiosulfonate (46.8 percent by weight) (available as BUSAN 25 from Buckman Laboratories Inc.); (13) a nonionic blend of methylene bis (thiocyanate) 50 percent by weight and 2-(thiocyanomethylthio) benzothiazole, 50 percent by weight, (available as BUSAN 1009, 1009WB from Buckman Laboratories Inc.); (14) a nonionic blend of 2-bromo-4'-hydroxyacetophenone (70 percent by weight) and 2-(thiocyanomethylthio)benzothiazole (30 percent by weight) (BUSAN 93 available from Buckman Laboratories Inc.); (15) a nonionic blend of 5-chloro-2-methyl-4-isothiazoline-3-one (75 percent by weight) and 2-methyl-4-isothiazolin-3-one (25 percent by weight), (available as AMERSTAT 250 from Drew Industrial Division; NALCON 7647 from NALCO Chemical Company; Kathon LY from Rohm and Haas Company); and the like, as well as mixtures thereof; (B) anionic biocides, such as (1) anionic potassium N-hydroxymethyl-N-methyl-dithiocarbamate (available as BUSAN 40 from Buckman Larboratories Inc.); (2) an anionic blend of N-hydroxymethyl-N-methyl dithiocarbamate (80 percent by weight) and sodium 2-mercapto benzothiazole (20 percent by weight) (available as BUSAN 52 from Buckman Laboratories Inc.); (3) an anionic blend of sodium dimethyl dithiocarbamate, 50 percent by weight, and (disodium ethylenebis-dithiocarbamate), 50 percent by weight, (available as METASOL 300 from Calgon Corporation; AMERSTAT 272 from Drew Industrial Division; SLIME CONTROL F from Western Chemical Company); (4) an anionic blend of Nomethyldithiocarbamate, 60 percent by weight, and disodium cyanodithioimidocarbonate, 40 percent by weight, (available as BUSAN 881 from Buckman Laboratories Inc.); (5) an anionic blend of methylene bis-thiocyanate (33 percent by weight), sodium dimethyl- dithiocarbamate (33 percent by weight), and sodium ethylene bisdithiocarbamate (33 percent by weight) (available as AMERSTAT 282 from Drew Industrial Division; AMA-131 from Vinings Chemical Company); (6) sodium dichlorophene (G-4-40 available from Givaudan Corporation); and the like, as well as mixtures thereof; (C) cationic biocides, such as (1) cationic poly(oxyethylene (dimethylamino)-ethylene (dimethylamino) ethylene dichloride) (Busan 77 available from Buckman Laboratories Inc.); (2) a cationic blend of methylene bisthiocyanate and dodecyl guanidine hydrochloride (available as SLIME TROL RX-31, RX-32, RX-32P, RX-33 from Betz Paper Chem Inc.); (3) a cationic blend of a sulfone, such as bis(trichloromethyl) sulfone and a quaternary ammonium chloride (available as SLIME TROL RX-36 DPB-865 from Betz Paper Chem. Inc.); (4) a cationic blend of methylene bis thiocyanate and chlorinated phenols (available as SLIME-TROL RX-40 from Betz Paper Chem. Inc.); and the like, as well as mixtures thereof. The biocide can be present in any effective amount; typically, the biocide is present in an amount of from about 0.1 to about 3 parts by weight of the coating, although the amount can be outside this range.

Examples of filler components include hollow microspheres including Eccospheres MC-37 (sodium borosilicate glass), Eccospheres FTD 202 (high silica glass, 95 percent $S10_2$), and Eccospheres SI (high silica glass, 98 percent $S10_2$), all available from Emerson and Cuming Inc.; Fillire 200/7 (alumino-silicate ceramic available from Fillite U.S.A.); Q-Cel 300 (sodium borosilicate available from Philadelphia Quartz); B23/500 (soda lime glass available from 3M Company); Ucar BJ0-0930 (phenolic polymers available from Union Carbide); Miralite 177 (vinylidene chloride-acrylonitrile available from Pierce & Stevens Chemical Corporation); and the like. Examples of solid microspheres include Spheriglass E250P2 and 10002A (soda-lime glass A-glass, E-glass), available from Potters Industries; Micro-P (soda-lime glass), available from D. J. Enterprises; ceramic microspheres (available from Fillite U.S.A. and Zeelan Industries); glass beads 3–10 microns (#07666 available from Polymer Sciences Inc); solid plastic microspheres available from Rohm & Haas, Dow Chemicals, Diamond Shamrock, and E. I. DuPont de Nemours & Company; hollow composite microspheres of polyvinylidene chloride/acrylonitrile copolymer shell 15 percent by weight and calcium carbonate 85 percent by weight, available as Dualite M 6001 AE, and Dualite M 6017 AE from Pierce & Stevens Corporation; and the like. Mixtures of two or more types of microspheres can also be employed. Microspheres are disclosed in, for example, *Encyclopedia of Polymer Science and Engineering*, vol. 9, pages 788 et seq., John Wiley and Sons (New York 1987), the disclosure of which is totally incorporated herein by reference, like stearate coated calcium carbonate, available as Camet-CAL, Camet-CAL ST from Genstar Stone Products Company; sodium metasilicate anhydrous available as Drymet 59 from Crossfield Chemicals, Incorporated, sodium metasilicate pentahydrate Crystamet 1020, Crystamet 2040, Crystamet 3080 from Crossfield Chemicals, Incorporated; organophilic montmorillonitrile clay available as Bentone 38CG, and magnesium aluminum silicate chemically modified, available as Bentone 38EV from Rheox Incorporated; magnesium carbonate, available as Elastocarb Tech Light, Elastocarb Tech Heavy, Elastocarb UF from Morton International; magnesium oxide, available as Elastomag 100, Elastomag 100 R, Elastomag 170, Elastomag 170 micropellet; zirconlure oxide (SF-EXTRA available from Z-Tech Corporation), colloidal silicas, such as Syloid 74 available from Grace Company (preferably present, in one embodiment, in an amount of from about 10 to about 70 percent by weight percent), amorphous silica available as Flow-Gard CC 120, Flow-Gard CC 140, Flow-Gard CC 160 from PPG Industries,titanium dioxide (available as Rutlie or Anatase from NL Chem Canada, Inc.), hydrated alumina (Hydrad TMC-HBF, Hydrad TM-HBC, available from J. M. Huber Corporation), barium sulfate (K. C. Blanc Fix HD80 available from Kali Chemie Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blends of calcium fluoride and silica, such as Opalex-C available from Kemira.O.Y, zinc oxide, such as Zoco Fax 183 available from Zo Chem, blends of zinc sulfide with barium sulfate, such as Lithopane available from Schteben Company, barium titanate, #20,810-8 available from Aldrich Chemicals, antimony oxide #23,089-8 available from Aldrich Chemicals, and the like, as well as mixtures thereof. Brightener fluorescent pigments of coumarin derivatives, such as Formula #633 available from Polymer Research Corporation of America; fluorescent pigments of oxazole derivatives, such as Formula #733 available from Polymer Research Corporation of America, can enhance color mixing and assist in improving print-through in recording sheets of the present invention.

The coating composition is present on one or both surfaces of the substrate of the coated paper of the present invention in any effective thickness. Typically, the total thickness of the coating layer is from about 0.1 to about 25 microns, and preferably from about 0.5 to 10 microns, although the thickness can be outside of these ranges.

The coatings can be applied to the substrate by any suitable technique, such as size press treatment, dip coating, reverse roll coating, extrusion coating, or the like. For example, the coating can be applied with a KRK size press (Kumagai Riki Kogyo Company, Ltd., Nerima, Tokyo, Japan) by dip coating and can be applied by solvent extrusion on a Faustel Coater. The KRK size press is a lab size press that simulates a commercial size press. This size press is normally sheet fed, whereas a commercial size press typically employs a continuous web. On the KRK size press, the substrate sheet is taped by one end to the carrier mechanism plate. The speed of the test and the roll pressures are set, and the coating solution is poured into the solution tank. A 4 liter stainless steel beaker is situated underneath for retaining the solution overflow. The coating solution is cycled once through the system (without moving the substrate sheet) to wet the surface of the rolls and then returned to the feed tank, where it is cycled a second time, and subsequently thereafter for application of the image receiving coating layer. While the rolls are being "wetted", the sheet is fed through the sizing rolls by pressing the carrier mechanism start button. The coated sheet is then removed from the carrier mechanism plate and is placed on a 12 inch by 40 inch sheet of 750 micron thick TEFLON® for support and is dried on the Dynamic Former drying drum and held under restraint to prevent shrinkage. The drying temperature is approximately 105° C. This method of coating treats both sides of the substrate simultaneously.

In dip coating, a web of the material to be coated is transported below the surface of the liquid coating composition by a single roll in such a manner that the exposed site is saturated, followed by removal of any excess coating by the squeeze rolls and drying at 100° C. in an air dryer. The liquid coating composition generally comprises the desired coating composition dissolved in a solvent such as water, methanol, or the like. The method of surface treating the substrate using a coater results in a continuous sheet of substrate with the coating material applied first to one side and then to the second side of the substrate. The substrate can also be coated by a slot extrusion process, wherein a flat die is situated with the die lips in close proximity to the web of substrate to be coated, resulting in a continuous film of the coating solution evenly distributed across one surface of the sheet, followed by drying in an air dryer at 100° C.

Coated papers of the present invention can be employed in ink jet printing processes. One embodiment of the present invention is directed to a process which comprises applying an aqueous recording liquid to the coated paper in an imagewise pattern. Another embodiment of the present invention is directed to a printing process which comprises (1) incorporating into an ink jet printing apparatus containing an aqueous ink a recording sheet of the present invention, and (2) causing droplets of the ink to be ejected in an imagewise pattern onto the recording sheet, thereby generating images on the coated papers. Ink jet printing processes are well known, and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are totally incorporated herein by reference. In a particularly preferred embodiment, the printing apparatus employs a thermal ink jet process wherein the ink in the nozzles is selectively heated in an imagewise pattern, thereby causing droplets of the ink to be ejected in imagewise pattern.

Coated papers of the present invention can be employed in printing and copying processes wherein dry or liquid electrophotographic-type developers are employed, such as electrophotographic processes, ionographic processes, or the like. Yet another embodiment of the present invention is directed to a process for generating images which comprises generating an electrostatic latent image on an imaging member in an imaging apparatus; developing the latent image with a toner; transferring the developed image to a recording sheet of the present invention; and optionally permanently affixing the transferred image to the coated paper. Still another embodiment of the present invention is directed to an imaging process which comprises generating an electrostatic latent image on a coated paper of the present invention, developing the latent image with a toner, and optionally permanently affixing the developed image to the recording sheet. Electrophotographic processes are known as described in, for example, U.S. Pat. No. 2,297,691. Ionographic and electrographic processes are also well known, and are described in, for example, U.S. Pat. No. 3,564,556, U.S. Pat. No. 3,611,419, U.S. Pat. No. 4,240,084, U.S. Pat. No. 4,569,584, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, and U.S. Pat. No. 4,155,093, the disclosures of each of which are totally incorporated herein by reference.

Coated papers of the present invention exhibit particularly low curling and acceptable toner fix in electrophotographic applications when the substrate plies are internally reinforced with latex polymers of ethylene-vinyl acetate, acrylic copolymers, and/or styrene-butadiene copolymers in an amount of from about 5 to about 20 percent by weight, and when the substrate is surface sized with starch. In addition, when the substrate plies have high internal sizing, surface treatment with latices, blends of latices with starch, blends of starch and polyethylene oxide, or blends of hydroxypropyl cellulose and starch, when coated onto the recording sheet surface, further reduce curl and improve toner fix.

The coated papers of the present invention can be used in any other printing or imaging process, such as printing with pen plotters, handwriting with ink pens (either aqueous or nonaqueous based inks), offset printing processes, or the like, provided that the ink employed to form the image is compatible with the material selected as the ink receiving layer of the recording sheet.

The drying time of images obtained with the coated papers of the present invention is the time for zero image-offset and can be measured as follows: a line comprising different color sequences is drawn on the paper with droplets of inks from an ink jet printhead moving from left to right and back. Thereafter, this image is purposely smeared with the pinch roll of the printer by fast forwarding the paper mechanically while the pinch roll is on the top of the imaged line. This entire procedure takes about two seconds to complete. In the event that no offset of the printed image on the unprinted paper occurs, the drying time of the image is considered as less than two seconds.

The coated papers of the present invention exhibit little or no blocking. Blocking refers to the transfer of ink or toner from a printed image from one sheet to another when coated papers are stacked together. The coated papers of the present invention exhibit substantially no blocking under, for example, environmental conditions of from about 20 to about 80 percent relative humidity and at temperatures of about 80° F.

Further, the coated papers of the present invention exhibit high resistance to humidity. Resistance to humidity generally is the capacity of a coated paper to control the blooming and bleeding of printed images, wherein blooming represents intra-diffusion of dyes and bleeding represents inter-diffusion of dyes. The blooming test can be performed by printing a bold filled letter such as "T" on a recording sheet and placing the sheet in a constant environment chamber preset for humidity and temperature. The vertical and horizontal spread of the dye in the letter "T" is monitored periodically under a microscope. Resistance to humidity limit is established when the dyes selected begin to diffuse out of the letter "T". The bleeding test is performed by printing a checker board square pattern of various different colors and measuring the inter-diffusion of colors as a function of humidity and temperature.

The Hercules size values recited herein were measured on the Hercules sizing tester (available from Hercules Incorporated) as described in TAPPI STANDARD T-530 pm-83, issued by the Technical Association of the Pulp and Paper Industry. This method is closely related to the widely used ink flotation test. The TAPPI method has the advantage over the ink flotation test of detecting the end point photometrically. The TAPPI method employs a mildly acidic aqueous dye solution as the penetrating component to permit optical detection of the liquid front as it moves through the paper sheet. The apparatus determines the time required for the reflectance of the sheet surface not in contact with the penetrant to drop to a predetermined (80 percent) percentage of its original reflectance.

Coated papers of the present invention exhibit reduced curl upon being printed with aqueous inks, particularly in situations wherein the ink image is dried by exposure to microwave radiation. Coated papers of the present invention exhibit curl values of less than 10 millimeters when used in electrophotographic apparatuses such as a xerographic copier such as Xerox 5760 color copier. Generally, the term "curl" refers to the distance between the base line of the arc formed by recording sheet when viewed in cross-section across its width (or shorter dimension, for example, 8.5 inches in an 8.5×11 inch sheet, as opposed to length, or longer dimension, for example, 11 inches in an 8.5×11 inch sheet) and the midpoint of the arc. To measure curl, a sheet can be held with the thumb and forefinger in the middle of one of the long edges of the sheet (for example, in the middle of one of the 11 inch edges in an 8.5×11 inch sheet), and the arc formed by the sheet can be matched against a predrawn standard template curve.

The edge raggedness values recited in the present application were measured using an Olympus microscope equipped with a camera capable of enlarging the recorded ink jet images. The edge raggedness value is the distance in millimeters for the intercolor bleed on a checkerboard pattern.

The optical density measurements and the print through values recited herein were obtained on a Pacific Spectrograph Color System. The system consists of two major components, an optical sensor and a data terminal. The optical sensor employs a 6 inch integrating sphere to provide diffuse illumination and 2 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters, and the entry of tristimulus values, and an alphanumeric keyboard for entry of product standard information. The print through value as characterized by the printing industry is Log base 10 (reflectance of a single sheet of unprinted paper against a black background/reflectance of the back side of a black printed area against a black background) measured at a wavelength of 560 nanometers.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLE I

Twenty coated papers were prepared by the solvent extrusion process (single side each time) on a Faustel coater by providing a substrate sheet of Xerox® 4024 paper (internally acid sized but without any surface sizing) obtained from Domtar Paper Company (in roll form) in a thickness of 108 microns, with internal sizing of 68 seconds and a porosity of 915 milliliters per minute. The sheets or papers were coated to a dry thickness of 2 microns with a barrier layer coating composition comprising 30 grams of the anticurl agent glycerol ethoxylate-b-propoxylate triol (Aldrich 40,918-9); 131.25 grams of polydimethylsiloxane emulsion SYL-OFF 7740,131, 25 grams of SYL-OFF 7741 catalyst available from Dow Chemical Compony, and 1,007.5 grams of water. The sheets were further coated with an ink receiving coating composition comprising 25 parts by weight of acrylic emulsion latex, Rhoplex B-15J, 9.0 parts by weight of dye fixative decamethylene his trimethyl ammonium bromide, (Aldrich 28,547-1), 1.0 part by weight of the biocide poly(oxyethylene (dimethylamino)-ethylene (dimethylamino) ethylene dichloride) (Busan 77 available from Buckman Laboratories Inc.); 3.0 parts by weight of the UV absorbing compound poly[N, N-bis(2,2,6,6-tetra methyl-4-piperidinyl)-1,6-hexanediamine-co-2,4-dichloro-6-morpholino-1,3,5-triazine)] (Cyasorb UV-3346, #41,324-0, available from Aldrich Chemical Company) and 2 parts by weight of an antioxidant compound N,N'-β,β'-naphthalene-ρ-phenylenediamine, available as Anchor DNPD from Anchor Corporation, and 60 parts by weight of the filler calcium carbonate Microwhite (obtained from Sylacauga Calcium Products); the mixture was present in a concentration of 25 percent by weight in water. Subsequent to drying at 100° C. and rewinding the coated side onto an empty core, the uncoated side was coated first with the barrier layer coating composition followed by the ink receiving coating composition. Subsequent to drying at 100° C. and monitoring the weight prior to and subsequent to coating, the sheets were coated with 1,500 milligrams of the coating (on each side) in a thickness of 15 microns (each side). The Hercules sizing degree of the coated papers were measured to be about 200 seconds.

The sheets thus prepared were incorporated into a Hewlett-Packard 500-C color ink jet printer containing inks of the following compositions:

Cyan:

Twenty percent by weight of ethylene glycol, 2.5 percent by weight of benzyl alcohol, 1.9 percent by weight of ammonium chloride, 0.1 percent by weight of DOWICIL 150 biocide, obtained from Dow Chemical Company, Midland, Mich., 0.05 percent by weight of polyethylene oxide (molecular weight 18,500), obtained from Union Carbide Company, 30 percent by weight of Projet Cyan 1 dye, obtained from ICI, and 45.45 percent by weight of water.

Magenta:

Twenty percent by weight of ethylene glycol, 2.5 percent by weight of benzyl alcohol, 1.9 percent by weight of ammonium chloride, 0.1 percent by weight of DOWICIL 150 biocide, obtained from Dow Chemical Company, Midland, Mich., 0.05 percent by weight of polyethylene oxide (molecular weight 18,500), obtained from Union Carbide Company, 2.5 percent by weight of Triton Direct Red 227, obtained from Tricon, and 72.95 percent by weight of water.

Yellow:

Twenty percent by weight of ethylene glycol, 2.5 percent by weight of benzyl alcohol, 1.9 percent by weight of ammonium chloride, 0.1 percent by weight of DOWICIL 150 biocide, obtained from Dow Chemical Company, Midland, Mich., 0.05 percent by weight of polyethylene oxide (molecular weight 18,500), obtained from Union Carbide Company, 3 percent by weight of Hoechst Duasyn Brilliant Yellow SF-GL VP220, obtained from Hoechst, 72.45 percent by weight of water.

Images were obtained which dried in less than 2 seconds with optical density values of 1.70 (black), 1.35 (magenta), 1.42 (cyan), 0.92 (yellow) before washing, and 1.50 (black), 1.30 (magenta), 1.45 (cyan) 0.90 (yellow) after washing at about 50° C. for two minutes, with edge raggedness values of 0.15 (between black and yellow), 0.25 (between cyan and yellow), 0.15 (between magenta and yellow), and 0.35 (between magenta and cyan), and a print through value of 0.025. The flat curl values for these papers were less than 30 millimeters, for example about 27 milliliters, an acceptable value. These papers could be duplexed without considerable print through.

EXAMPLE II

Twenty coated papers were prepared by the solvent extrusion process (single side each time) on a Faustel coater by providing a substrate sheet of Xerox® 4024 paper (internally acid sized but without any surface sizing) obtained from Domtar Paper Company (in roll form) in a thickness of 108 microns with internal sizing of 68 seconds and a porosity of 915 milliliters per minute. The sheets or papers were coated with a barrier layer coating composition comprising 100 grams of anticurl agent pentaerythritol propoxylate/ethoxylate (Aldrich 42,502-8); 100 grams of polyurethane emulsion, and available as grapHsize from Akzo Chemicals Company, in a thickness of 3 microns dried. The sheets were further coated with an ink receiving coating composition comprising 25 parts by weight of poly(vinyl alcohol) ethoxylated, #6573 available from Poly Sciences Inc., 9.0 parts by weight of dye fixative myristyl trimethyl ammonium bromide (Aldrich 86,042-5), 1.0 part by weight of the biocide poly(oxyethylene (dimethylamino) -ethylene (dimethylamino) ethylene dichloride) (Busan 77 available from Buckman Laboratories Inc.); 3.0 parts by weight of the UV absorbing compound poly[N,N-bis(2,2,6,6-tetramethyl-4-piperidinyl)-1,6-hexanediamine-co-2,4-dichloro-6-morpholino-1,3,5-triazine)] (Cyasorb UV-3346, #41,324-0, available from Aldrich Chemical Company) and 2 parts by weight of the antioxidant compound N,N'-β,β'-naphthalene-ρ-phenylenediamine, available as Anchor DNPD from Anchor Corporation, and 60 parts by weight of the filler colloidal silica Syloid 74, available from W. R. Grace and Company; the mixture was present in a concentration of 25 percent by weight in water. Subsequent to drying at 100° C. and rewinding the coated side onto an empty core, the uncoated side was coated first with with the barrier layer coating composition followed by the ink receiving coating composition. Subsequent to drying at 100° C. and monitoring the weight prior to and subsequent to coating, the sheets were coated with 1,500 milligrams of the coating (on each side) in a thickness of 15 microns (each side). The Hercules sizing degree of the coated papers were measured to be about 220 seconds.

The recording sheets thus prepared were incorporated into a Hewlett-Packard 500-C color ink jet printer containing inks of the following compositions:

Cyan:

Twenty percent by weight of ethylene glycol, 2.5 percent by weight of benzyl alcohol, 1.9 percent by weight of ammonium chloride, 0.1 percent by weight of DOWICIL 150 biocide, obtained from Dow Chemical Company, Midland, Mich., 0.05 percent by weight of polyethylene oxide (molecular weight 18,500), obtained from Union Carbide Company), 30 percent by weight of Projet Cyan 1 dye, obtained from ICI, and 45.45 percent by weight of water.

Magenta:

Twenty percent by weight of ethylene glycol, 2.5 percent by weight of benzyl alcohol, 1.9 percent by weight of ammonium chloride, 0.1 percent by weight of DOWICIL 150 biocide, obtained from Dow Chemical Company, Midland, Mich., 0.05 percent by weight of polyethylene oxide (molecular weight 18,500), obtained from Union Carbide Company), 2.5 percent by weight of Triton Direct Red 227, obtained from Tricon, and 72.95 percent by weight of water.

Yellow:

Twenty percent by weight of ethylene glycol, 2.5 percent by weight of benzyl alcohol, 1.9 percent by weight of ammonium chloride, 0.1 percent by weight of DOWICIL 150 biocide, obtained from Dow Chemical Company, Midland, Mich., 0.05 percent by weight of polyethylene oxide (molecular weight 18,500), obtained from Union Carbide Company), 3 percent by weight of Hoechst Duasyn Brilliant Yellow SF-GL VP220, obtained from Hoechst, and 72.45 percent by weight of water.

Images were obtained which dried in less than 2 seconds with optical density values of 1.80 (black), 1.45 (magenta), 1.50 (cyan), 0.95 (yellow) before washing, and 1.70 (black), 1.40 (magenta), 1.45 (cyan) 0.90 (yellow) after washing at about 50° C. for two minutes with edge raggedness values of 0.13 (between black and yellow), 0.20 (between cyan and yellow), 0.14 (between magenta and yellow), and 0.30 (between magenta and cyan), and a print through value of 0.020. The flat curl values for these papers were less than 20 millimeters. These papers could be duplexed without considerable print through.

EXAMPLE III

Twenty coated papers were prepared by the solvent extrusion process (single side each time) on a Faustel coater by providing a substrate sheet of Xerox® 4024 paper (internally acid sized but without any surface sizing) obtained from Domtar Paper Company (in roll form) in a thickness of 108 microns with internal sizing of 68 seconds and a porosity of 915 milliliters per minute. The sheets were coated to 1.5 microns in thickness with a barrier layer coating composition comprising 30 grams of anticurl agent trimethylolpropane propoxylate triacrylate (Aldrich 40,756-9; 40,757-7); 131.25 grams of polydimethylsiloxane emulsion SYL-OFF 7740, 131.25 grams of SYL-OFF 7741 catalyst, and 1007.5 grams of water. The sheets were further coated with a toner developed image receiving coating composition comprising 30 parts by weight of polyester latex, Eastman AQ 29D available from Eastman Chemical Company; 3.0 parts by weight of the antistatic agent ethyl triphenyl phosphonium bromide (Aldrich 21,959-2), 2.0 parts by weight of the biocide potassium N-hydroxymethyl-N-methyl-dithiocarbamate (available as BUSAN 40 from Buckman Larboratories Inc.); 3.0 parts by weight of the UV absorbing compound 2-[2'-hydroxy-3,5-di-(1,1-dimethylbenzyl)phenyl]-2H-benzotriazole, available as Topanex 100BT from ICI America Corporation and 2 parts by weight of the antioxidant compound N,N'-β,β'-naphthalene-ρ-phenylenediamine, available as Anchor DNPD from Anchor Corporation, and 60 parts by weight of the filler calcium carbonate Microwhite (obtained from Sylacauga Calcium Products); the mixture was present in a concentration of 25 percent by weight in water. Subsequent to drying at 100° C. and rewinding the coated side onto an empty core, the uncoated side was coated first with the barrier layer coating composition followed by the toner receiving coating composition. Subsequent to drying at 100° C. and monitoring the weight prior to and subsequent to coating, the sheets were coated with 1,500 milligrams of the coating (on each side) in a thickness of 15 microns (each side). The Hercules sizing degree of the coated papers were measured to be about 180 seconds.

The above prepared papers were utilized in a Xerox 5760 MajestiK Digital Color Copier carrying polyester resin based toners and images were obtained on the toner receiving side of the recording sheet. These images had optical density values of 1.45 (cyan), 1.28 (magenta), 0.89 (yellow) and 1.50 (black). These images were waterfast when washed with water for 2 minutes at 50° C. and lightfast for a period of three months without any change in their optical density. The flat curl values for these papers were less than 30 millimeters. These papers could be duplexed without considerable print through.

Other embodiments and modifications of the present invention may occur to those skilled in the art subsequent to a review of the information presented herein, these embodiments and modifications, as well as equivalents thereof, are also included within the scope of this invention.

What is claimed is:

1. A coated paper which comprises (a) a substrate; (b) a hydrophobic barrier layer comprised of a water insoluble component and a water soluble or alcohol soluble anticurl agent, said hydrophobic barrier layer being present on both sides of the substrate; (c) an image receiving coating situated on the hydrophobic barrier layers, said coating comprising (1) a polymeric binder, (2) a dye fixative, (3) a lightfastness inducing agent, (4) a filler, and (5) a biocide.

2. A coated paper according to claim 1 wherein the substrate is an internally sized paper with no surface sizing, surface sized paper with no internal sizing, surface and internally sized paper, an alkaline sized paper, an acid sized paper, sized filled paper, or sized filled pigmented paper.

3. A coated paper according to claim 1 wherein the substrate has a thickness of from about 50 to about 250 microns.

4. A coated paper according to claim 1 wherein each barrier layer has a thickness of from about 1 to about 10 microns.

5. A coated paper according to claim 1 wherein the water insoluble component is formed from a material selected from the group consisting of (1) polyurethane emulsion containing 50 parts water and 50 parts polymer, (2) polyethylene wax emulsion containing 70 parts water and 30 parts polymer, (3) paraffin wax emulsions, (4) poly(dimethyl siloxane)-b-poly(propylene oxide)-b-poly(ethylene oxide) copolymers, (5) sodium stearate, (6) aluminum distearate, (7) magnesium stearate, (8) zinc stearate, (9) calcium stearate, (10) stearyl methicone, (11) cetyl dimethicone, (12) stearyl dimethicone, (13) stearoxy dimethicone, (14) behenoxy dimethicone, (15) behenamide, (16) erucamide, (17) stearyl erucamide, (18) erucyl erucamide, (19) oleamide, (20) oleyl palmitamide, (21) stearamide, (22) stearyl stearamide, (23) erucyl stearamide, (24) ethylene dioleamide, (25) ethylene distearamide, (26) nonyl phenol ethoxylate phosphate ester, (27) sodium cumene sulfonate, (28) ammonium xylene sulfonate, (29) sodium xylene sulfonate, (30) potassium xylene sulfonate, (31) magnesium xylene sulfonate, (32) sodium toluene sulfonate, (33) potassium toluene sulfonate, (34) cocoamphodiacetate, (35) lauroamphodiacetate, (36) capryloamphopropionate, (37) tallamphopropionate (38) isostearoamphopropinate, (39) cocoamphodipropionate, and (40) caprylic/capric monocarboxylic propionate imidazoline.

6. A coated paper according to claim 1 wherein the water soluble anticurl agent of the barrier layer is selected from the group consisting of trimethylolpropane, trimethylolpropane ethoxylate, trimethylolpropane triacrylate, trimethylolpropane trimethacrylate, trimethylolpropane ethoxylate triacrylate, trimethylolpropane propoxylate triacrylate, trimethylolpropane ethoxylate methylether diacrylate, trimethylolpropane tris(2-methyl-1-aziridinepropionate), neopentyl glycol ethoxylate neopentyl glycol propoxylate, glycerol propoxylate, glycerol propoxylate-b-ethoxylate triol, glycerol ethoxylate-b-propoxylate triol, pentaerythritol ethoxylate, pentaerythritol propoxylate, pentaerythritol propoxylate/ethoxylate, triethanol amine ethoxylate, N-methyl diethanolamine, N-ethyl diethanolamine, N-butyl diethanolamine, N-phenyl diethanolamine, triethanol amine, trioctylamine, ρ-xylylene diamine, 1,4-bis(2-hydroxyethoxy)-2-butyne, pantothenol, 1-phenyl-1,2-ethanediol, 3-methoxy-1,2-propanediol, 3-allyloxy-1,2-propanediol, 3-ethoxy-1,2-propanediol, 3-phenoxy-1,2-propanediol, 3-octadecyloxy-1,2-propanediol, 3-(4-methoxy phenoxy)-1,2-propanediol, mephensin[3-(2-methyl phenoxy)-1,2-propanediol], 3-amino-1,2-propanediol, 3-(diethylamino)-1,2-propanediol, 2-phenyl-1,2-propanediol, 3-(diisopropyl amino)-1,2-propanediol, 3-(N-benzyl-N-methylamino)-1,2-propanediol, 3-pyrrolidino-1,2-propanediol, 3-piperidino-1,2-propanediol, 3-morpholino-1,2-propanediol, 2,2-dimethyl-1-phenyl-1,3-propanediol, 2-benzyloxy-1,3-propanediol, 4-8-bis(hydroxymethyl)tricyclo[5.2.1.02.6]decane, 1-[N,N-bis(2-hydroxyethyl)isopropanolamine, N,N-bis(2-hydroxypropyl)ethanolamine, 1-[2-(2-hydroxyethoxy)ethyl]-piperazine, 1-4-bis(2-hydroxyethyl)piperazine, homovanillyl alcohol, phenethyl alcohol, 3,6-dimethyl-4-octyne-3,6-diol, 2-(hydroxymethyl)-1,3-propanediol, 2-butyl-2-ethyl-1,3-propanediol, 2-piperidine methanol, 2,2,4-trimethyl-1,3-pentanediol, Vitamin E, Vitamin E acetate, Vitamin K, tri(ethylene glycol)dimethylacrylate, triethyl citrate, 2,4,7,9-tetramethyl-5-decyne-4,7-diol, and mixtures thereof.

7. A coated paper according to claim 1 wherein the polymeric binder of the image receiving coating is formed from a material selected from the group consisting of rubber latices, polyester latices, vinyl chloride homopolymer latices, ethylene-vinyl chloride copolymer emulsions, polyvinyl acetate homopolymer emulsions, carboxylated vinyl acetate homopolymer emulsion resins, vinyl acetate copolymer latices, vinyl acrylic terpolymer latices, acrylic homopolymer emulsion latices, polystyrene homopolymer latices, styrene-butadiene copolymer latices, butadiene-acrylonitrile copolymer latices, and butadiene-acrylonitrile-styrene terpolymer latices.

8. A coated paper according to claim 1 wherein the polymeric binder polymer of the image receiving coating is selected from the group consisting of (1) starch, (2) cationic starch, (3) hydroxypropyl starch, (4) hydroxyethyl starch, (5) gelatin, (6) methyl cellulose, (7) benzyl cellulose, (8) phenyl cellulose, (9) hydroxyethyl cellulose, (10) hydroxypropyl cellulose, (11) ethyl hydroxyethyl cellulose, (12) hydroxyethyl methyl cellulose, (13) hydroxypropyl methyl cellulose, (14) hydroxy butylmethyl cellulose, (15) dihydroxypropyl cellulose, (16) hydroxypropyl hydroxyethyl cellulose, (17) chlorodeoxycellulose, (18) amino deoxycellulose, (19) diethylammonium chloride hydroxy ethyl cellulose, (20) hydroxypropyl trimethyl ammonium chloride hydroxyethyl cellulose, (21) diethyl aminoethyl cellulose, (22) carboxymethyl dextrans, (23) diethyl aminoethyl dextran, (24) amino dextran, (25) sodium carboxymethyl cellulose, (26) gum arabic, (27) carrageenan, (28) Karaya gum, (29) xanthan, (30) chitosan, (31) carboxymethyl hydroxypropyl guar, (32) cationic guar, (33) n-carboxymethyl chitin, (34) dimethyl ammonium hydrolyzed collagen protein, (35) agar-agar, (36) sodium cellulose sulfate, and (31) sodium carboxymethylhydroxyethyl cellulose.

9. A coated paper according to claim 1 wherein the polymeric binder is selected from the group consisting of (1) poly(vinyl alcohol), (2) poly(vinyl phosphate), (3) poly (vinyl pyrrolidone), (4) vinyl pyrrolidone-vinyl acetate copolymers, (5) vinyl pyrrolidone-styrene copolymers, (6) poly(vinylamine), (7) poly(vinyl alcohol) ethoxylated, (8) poly(vinyl pyrrolidone-diethylaminomethylmethacrylate), (9) vinyl alcohol-vinyl acetate copolymer, (10) vinyl alcohol-vinyl butyral copolymer, (11) melamine-formaldehyde resin, (12) urea-formaldehyde resin, (13) methylated urea-formaldehyde resins, (14) poly(2-acrylamide-2-methyl propane sulfonic acid), (15) poly(N,N-dimethyl-3,5-dimethylene piperidinium chloride), (16) poly(methylene-guanidine) hydrochloride, (17) styrene-maleic anhydride copolymers, (18) vinyl methyl ether-maleic anhydride copolymer, (19) ethylene-maleic anhydride copolymer, (20) butadiene-maleic acid copolymers, (21) vinylmethylether-maleic acid copolymer, (22) methyl vinyl ether-maleic acid ester, (23) poly(acrylamide), (24) acrylamide-acrylic acid copolymers, (25) poly(N,N-dimethyl acrylamide), (26) poly(ethylene imine), (27) poly (ethylene imine) epichlorohydrin, (28) ethoxylated polyimine, (29) poly(ethylene oxide), (30) ethylene oxide/propylene oxide copolymers, (31) ethylene oxide/2-hydroxyethyl methacrylate/ethylene oxide, (32) ethylene oxide/hydroxypropyl methacrylate/ethylene oxide triblock copolymers, (33) ionene/ethylene oxide/ionene triblock copolymers, (34) ethylene oxide/isoprene/ethylene oxide triblock copolymers, and (35) epichlorohydrin-ethylene oxide copolymer.

10. A coated paper according to claim 1 wherein the lightfastness inducing agent is selected from the group consisting of (1) glycerol ρ-amino benzoate, (2) resorcinol mono benzoate, (3) octyl dimethyl amino benzoate, (4) hexadecyl 3,5-di-tert-butyl-4-hydroxybenzoate, (5) octyl salicylate, (6) octyl methoxy cinnamate, (7) 4-allyloxy-2-hydroxybenzophenone, (8) 2-hydroxy-4-methoxy benzophenone, (9) 2,2'-dihydroxy-4,4'-dimethoxy benzophenone, (10) 2-hydroxy-4-(octyloxy)benzophenone, (11) 2-hydroxy-4-dodecyloxy benzophenone, (12) 2-(2'-hydroxy-5'-methylphenyl)benzotriazole, (13) 2-[2'-hydroxy-3,5-di-(1,1-dimethyl benzyl)phenyl]-2H-benzotriazole, (14) bis[2-hydroxy-5-tert-octyl-3-(benzotriazol-2-yl) phenyl methane], (15) 2-(3',5'-di-tert-butyl-2'-hydroxyphenyl)-5-chlorobenzotriazole, (16) 2-(4-benzoyl-3-hydroxyphenoxy)ethylacrylate, (17) poly[2-(4-benzoyl-3-hydroxyphenoxy)ethylacrylate], (18) N-(ρ-ethoxycarbonyl phenyl)-N'-ethyl-N'-phenyl formadine, (19) 1,1-(1,2-ethane-diyl) bis(3,3,5,5-tetramethyl piperazinone), (20) tris(3,5-di-tert-butyl-4-hydroxybenzyl)isocyanurate, (21) nickel bis(o-ethyl(3,5-di-tert-butyl-4-hydroxybenzyl) phosphonate), (22) 2,2,6,6-tetramethyl-4-piperidinyl-1,2,3,4-butane tetracarboxylate, (23) [2,2,6,6-tetramethyl-4-piperidinyl/β,β,β',β'-tetramethyl-3,9-(2,4,8,10-tetraoxospiro(5,5)undecane)diethyl]-1,2,3,4-butane tetracarboxylate, (24) [1,2,2,6,6-pentamethyl-4-piperidinyl/β,β,β',β'-tetramethyl-3,9-(2,4,8,10-tetraoxospiro(5,5)undecane)diethyl]-1,2,3,4-butane tetracarboxylate, (25) 2-dodecyl-N-(2,2,6,6-tetramethyl-4-piperidinyl)succinimide, (26) 2-dodecyl-N-(1,2,2,6,6-pentamethyl-4-piperidinyl)succinimide, (27) N-(1-acetyl-2,2,6,6-tetramethyl-4-piperidinyl)-2-dodecyl succinimide, (28) tetra sodium N-(1,2-dicarboxyethyl)-N-octadecyl sulfosuccinamate, (29) nickel dibutyldithiocarbamate, (30) poly(4-hydroxy-2,2,6,6-tetramethyl-1-piperidine ethanol/dimethyl succinic acid), (31) poly(3,5-di-tertobutyl-4-hydroxy hydrocinnamic acid ester)/1,3,5-tris(2-hydroxyethyl)-5-triazine-2,4,6(1H,3H,5H)-trione, (32) poly[N,N-bis(2,2,6,6-tetramethyl-4-piperidinyl)-1,6-hexanediamine-co-2,4-dichloro-6-morpholino-1,3,5-triazine)], (33) 1-[N-[poly(3-allyloxy-2-hydroxypropyl)-2-aminoethyl]-2-imidazolidinone, and (34) poly(2-ethyl-2-oxazoline).

11. A coated paper according to claim 1 wherein the filler is selected from the group consisting of (1) microspheres of sodium borosilicate glass, (2) microspheres of soda lime glass, (3) microspheres of phenolic polymers, (4) vinylidene chloride-acrylonitrile microspheres, (5) hollow composite microspheres of polyvinylidene chloride/acrylonitrile copolymer shell, 15 percent by weight, and calcium carbonate, 85 percent by weight, (6) stearate coated calcium carbonate, (7) sodium metasilicate anhydrous, (8) sodium metasilicate pentahydrate, (9) organophilic montmorillonitrile clay, (10) magnesium aluminum silicate, (11) magnesium carbonate, (12) magnesium oxide, (13) zirconlure oxide, (14) colloidal silicas, (15) titanium dioxide, (16) hydrated alumina, (17) barium sulfate, (18) calcium carbonate, (19) high brightness clays, (20) calcium silicate, (21) blends of calcium fluoride and silica, (22) zinc oxide, (23) blends of zinc sulfide with barium sulfate, (24) barium titanate, (25) brightener fluorescent pigments of coumarin, (26) fluorescent pigments of oxazole, and (27) antimony oxide.

12. A coated paper according to claim 1 wherein the dye fixative is a quaternary acrylic copolymer of the formula

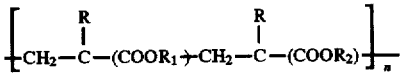

wherein n is a number of from about 10 to about 100; R is hydrogen or alkyl; $R_1$ is hydrogen, an alkyl group, or an aryl group; and $R_2$ is $N^+(CH_3)_3X^-$, wherein X is an anion; and the degree of quaternization is from about 1 to about 100 percent.

13. A coated paper according to claim 1 wherein the dye fixative is a monoammonium compound selected from the group consisting of tetramethyl ammonium bromide, tetra octadecyl ammonium bromide, 4-nitrobenzyl trimethyl ammonium chloride, decamethylene bis trimethyl ammonium bromide, myristyl trimethyl ammonium bromide, stearyl trimethyl ammonium chloride, 1,5-dimethyl-1,5-diaza undecamethylene polymethobromide, benzyl behenyl dimethyl ammonium chloride, didecyl dimethyl ammonium chloride, didecyl dimethyl ammonium bromide, tallow dimethyl trimethyl propylene diammonium chloride, N-cetyl, and N-ethyl morpholinium ethosulfate.

14. A coated paper according to claim 1 wherein the dye fixative is a phosphonium compound selected from the group consisting of ethyl triphenyl phosphonium bromide, hexyl triphenyl phosphonium bromide, 2-hydroxyethyl triphenyl phosphonium bromide, 2-hydroxybenzyl triphenyl phosphonium bromide, carbethoxymethyl triphenyl phosphonium bromide, 4-butoxybenzyl triphenyl phosphonium bromide, tetra phenyl phosphonium iodide, and p-xylylene bis(triphenyl phosphonium bromide).

15. A coated paper according to claim 1 wherein the image receiving coating has a thickness of from about 0.1 to about 25 microns.

16. A coated paper in accordance with claim 1 wherein said water insoluble component is formed from a polyurethane emulsion, a polyethylene wax emulsion, a paraffin wax emulsion, poly(dimethyl siloxane)-b-poly(propylene oxide)-b-poly(ethylene oxide) copolymer, or sodium stearate; the water soluble anticurl agent is trimethylolpropane ethoxylate, trimethylolpropane triacrylate, trimethylolpropane ethoxylate triacrylate, trimethylolpropane propoxylate triacrylate, glycerol propoxylate, glycerol propoxylate-b-ethoxylate triol, glycerol ethoxylate-b-propoxylate triol, pentaerythritol ethoxylate, pentaerythritol propoxylate, or pentaerythritol propoxylate/ethoxylate; and the lightfastness inducing agent is octyl methoxy cinnamate, poly[N,N-bis (2,2,6,6-tetramethyl-4-piperidinyl)-1,6-hexane diamine-co-2,4-dichloro-6-morpholino-1,3,5-triazine)],2-[2'-hydroxy-3,5-di-(1,1-dimethyl benzyl)phenyl]-2H-benzotriazole, or 2-hydroxy-4-dodecyloxy benzophenone.

17. A coated paper which comprises (a) a substrate; (b) thereover and thereunder a hydrophobic barrier layer comprised of a water insoluble component, and a water soluble anticurl agent; (c) an image receiving coating layer situated on each hydrophobic barrier layer, said coating comprising (1) a polymeric binder, (2) an antistatic agent, (3) a lightfastness inducing agent, (4) a filler, and (5) an optional biocide.

18. A coated paper in accordance with claim 2 wherein the water insoluble component of the hydrophobic barrier layer is present in an amount of from about 25 to about 70 parts by weight, the anticurl agent is present in an amount of from about 75 to about 30 parts by weight, and in the image receiving layer the binder is present in amounts of from about 10 to about 35 parts by weight, the antistatic agent is present in an amount of from about from about 3 to about 5 parts by weight, the lightfastness mixture is present in amounts of from about 0.4 to about 8 parts by weight, the filler is present in amounts of from about 86 parts by weight to about 50 parts by weight, and the biocide is present in amounts of from about 0.6 parts by weight to about 2 parts by weight.

19. A printing process which comprises incorporating into an ink jet printing apparatus containing an aqueous ink a coated paper which comprises (a) a substrate; (b) a hydrophobic barrier layer comprised of a water insoluble component, and a water soluble or alcohol soluble anticurl agent, said hydrophobic barrier layer being present on both sides of the substrate; (c) an image receiving coating situated on each hydrophobic barrier layer, said image receiving coating being suitable for receiving images of an aqueous ink, said coating comprising (1) a polymeric binder, (2) a dye fixative, (3) a lightfastness inducing agent, (4) a filler, and (5) a biocide; and causing droplets of the ink to be ejected in an imagewise pattern onto the coated paper, thereby generating images on the coated paper.

20. A printing process according to claim 19 wherein the printing apparatus employs a thermal ink jet process wherein the ink in the nozzles is selectively heated in an imagewise pattern, thereby causing droplets of the ink to be ejected in imagewise pattern.

21. A process for generating images which comprises generating an electrostatic latent image on an imaging member in an imaging apparatus; developing the latent image with a toner; transferring the developed image to a coated paper which comprises (a) a substrate; (b) a hydrophobic barrier layer comprised of a water insoluble component, and a water soluble or alcohol soluble anticurl agent, said hydrophobic barrier layer being present on both sides of the substrate; (c) an image receiving coating situated on each hydrophobic barrier layer, said image receiving coating being suitable for receiving images of an electrostatic toner composition, said coating comprising (1) a polymeric binder, (2) an antistatic agent, (3) a lightfastness inducing agent, (4) a filler, and (5) an optional biocide; and optionally permanently affixing the transferred image to the coated paper.

22. A coated paper comprised of (a) a supporting paper substrate coated thereunder and thereover with a hydrophobic barrier layer comprised of a blend of polydimethylsiloxane and the anticurl agent glycerol ethoxylate-b-propoxylate triol; (b) an image receiving coating situated on each hydrophobic barrier layer, said image receiving coating being suitable for receiving images of an aqueous ink, said coating being formed from (1) as the polymeric binder, an acrylic emulsion latex, (2) the dye fixative decamethylene bis trimethyl ammonium bromide, (3) the lightfastness inducing composition comprised of the UV absorbing compound poly[N,N-bis(2,2,6,6-tetramethyl-4-piperidinyl)-1,6-hexane diamine-co-2,4-dichloro-6-morpholino-1,3,5-triazine), and the antioxidant compound N,N'-β,β'-naphthalene-ρ-phenylenediamine, (4) the filler, calcium carbonate, and (5) the biocide poly(oxyethylene (dimethylamino)ethylene(dimethylamino)ethylene dichloride).

23. A coated paper in accordance with claim 22 wherein the thickness of each hydrophobic barrier layer is from about 0.5 to about 3 microns, and the thickness of the ink receiving layer is from about 5 to about 15 microns.

24. A coated paper in accordance with claim 22 wherein the water insoluble component of the hydrophobic barrier layer is present in an amount of from about 25 to about 70 parts by weight, the anticurl agent is present in an amount of from about 75 to about 30 parts by weight, and in the ink receiving layer the binder is present in amounts of from about 10 to about 25 parts by weight, the dye fixative is present in an amount of from about 3 to about 15 parts by weight, the lightfastness inducing agent is present in an amount of from about 0.4 to about 8 parts by weight, the filler is present from about 86 to about 50 parts by weight, and the biocide is present in an amount of from about 0.6 to about 2 parts by weight.

25. A coated paper comprised of (a) a supporting paper substrate coated with a hydrophobic barrier layer comprised of a blend of polydimethylsiloxane and the anticurl agent trimethylolpropane propoxylate triacrylate, said hydrophobic barrier layer being present on both sides, of the substrate; (b) an image receiving coating situated on the top of both hydrophobic barrier layers, said image receiving coating being suitable for receiving images of an electrostatic toner composition, said coating being formed from comprising (1) a polymeric binder polyester latex, (2) an antistatic agent ethyl triphenyl phosphonium bromide, (3) a lightfastness inducing composition containing a mixture of the UV absorbing compound 2-[2'-hydroxy-3,5-di-(1,1-dimethyl benzyl)phenyl]-2H-benzotriazole and the antioxidant compound N,N'-β,β'-naphthalene-ρ-phenylenediamine, (4) a filler of calcium carbonate, and (5) the biocide potassium N-hydroxymethyl-N-methyl-dithiocarbamate.

26. A coated paper in accordance with claim 25 wherein the thickness of the hydrophobic barrier layer is from about 0.5 to about 3 microns, and the thickness of the toner receiving layer is from about 5 to about 15 microns.

27. A coated paper in accordance with claim 1 wherein the dye fixative is decamethylene his trimethyl ammonium bromide.

* * * * *